US007406840B2

(12) United States Patent
Brancato

(10) Patent No.: US 7,406,840 B2
(45) Date of Patent: Aug. 5, 2008

(54) MULTI-FUNCTION JEWELRY CHAIN PRIMARILY FOR SUPPORTING AN UPPER TORSO GARMENT

(76) Inventor: Theresa M. Brancato, 22 Connor La., Deer Park, NY (US) 11729

( * ) Notice: Subject to any disclaimer, the term of this patent is extended or adjusted under 35 U.S.C. 154(b) by 0 days.

(21) Appl. No.: 10/209,462

(22) Filed: Jul. 31, 2002

(65) Prior Publication Data

US 2004/0020240 A1 Feb. 5, 2004

(51) Int. Cl.
*A44C 5/00* (2006.01)

(52) U.S. Cl. ..... 63/4; 63/3; 63/33; 63/41

(58) Field of Classification Search ..... 63/1.11, 63/1.16, 3, 3.1, 3.2, 4, 1.17, 41, 38; D11/3, D11/11–13; 2/301, 308, 339; 59/78, 80; D2/700; 450/1, 86, 88
See application file for complete search history.

(56) References Cited

U.S. PATENT DOCUMENTS

| | | | | | |
|---|---|---|---|---|---|
| 1,410,306 | A | * | 3/1922 | Hoffmann et al. | 24/300 |
| 1,457,350 | A | * | 6/1923 | Damiano | 63/3.2 |
| 1,491,578 | A | * | 4/1924 | Ballou et al. | 2/326 |
| 1,683,545 | A | * | 9/1928 | Harris | 63/1.15 |
| 1,762,502 | A | * | 6/1930 | Brooks | 63/1.18 |
| 2,224,721 | A | | 12/1940 | Chernov | |
| 3,456,457 | A | * | 7/1969 | Cass | 63/33 |
| 3,733,852 | A | * | 5/1973 | Johnson et al. | 63/37 |
| 4,400,932 | A | | 8/1983 | Epstein | |
| 4,651,541 | A | | 3/1987 | Farley | |
| D294,194 | S | * | 2/1988 | Herrick | D2/500 |
| D296,997 | S | | 8/1988 | Dobson | |
| 4,815,180 | A | | 3/1989 | Elsener | |
| 5,592,835 | A | | 1/1997 | Herr | |
| 5,615,454 | A | | 4/1997 | Contarino | |
| 6,086,451 | A | * | 7/2000 | Fernandes | 450/86 |
| 6,158,206 | A | | 12/2000 | Rosenwasser | |
| 6,209,306 | B1 | | 4/2001 | Chia | |
| 6,250,107 | B1 | | 6/2001 | Visser | |
| 6,263,658 | B1 | | 7/2001 | Rosenwasser | |
| 6,279,171 | B1 | | 8/2001 | Brancato | |
| 6,339,922 | B1 | | 1/2002 | Foster | |
| 6,401,488 | B1 | * | 6/2002 | Cousin et al. | 63/3 |
| 6,520,635 | B1 | * | 2/2003 | Ignatowski | 351/52 |
| 6,553,636 | B1 | * | 4/2003 | Brenner | 24/599.6 |
| 2002/0078707 | A1 | * | 6/2002 | Walker et al. | 63/3.2 |
| 2002/0148251 | A1 | * | 10/2002 | Plumly | 63/3 |
| 2003/0209034 | A1 | * | 11/2003 | Huang | 63/4 |
| 2004/0007017 | A1 | * | 1/2004 | Flaherty | 63/3.1 |

* cited by examiner

*Primary Examiner*—Jack W. Lavinder
(74) *Attorney, Agent, or Firm*—Bernard S. Hoffman

(57) ABSTRACT

A length adjustable, multi-function chain composite for use in the apparel, jewelry, and accessory industries. The length adjustable, multi-function chain composite includes at least two chain segments that are separate and independent of each other, and apparatus that is operatively connected to the at least two chain segments and replaceably attaches the at least two chain segments end-to-end collinearly so as to allow the length adjustable, multi-function chain composite to be reconfigurable for being multi-functional.

19 Claims, 20 Drawing Sheets

Fig. 1
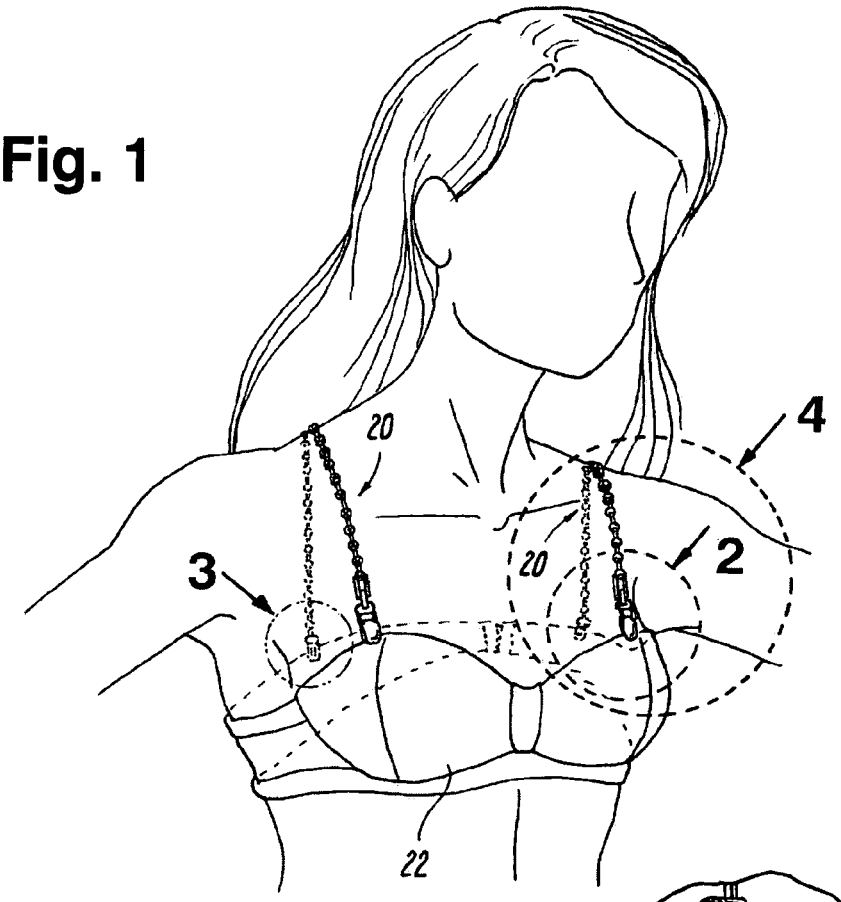
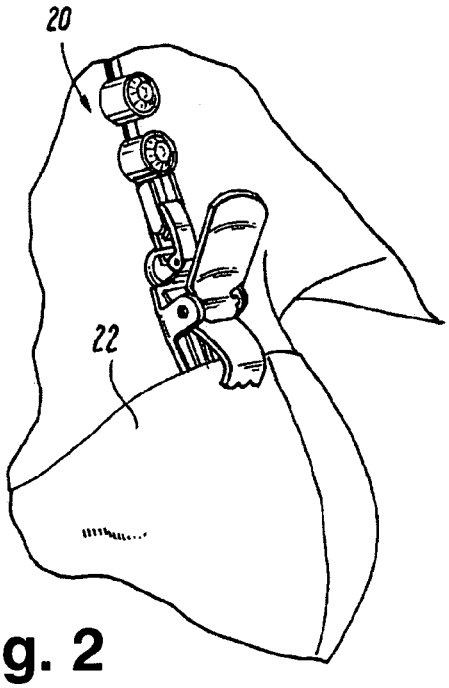
Fig. 2
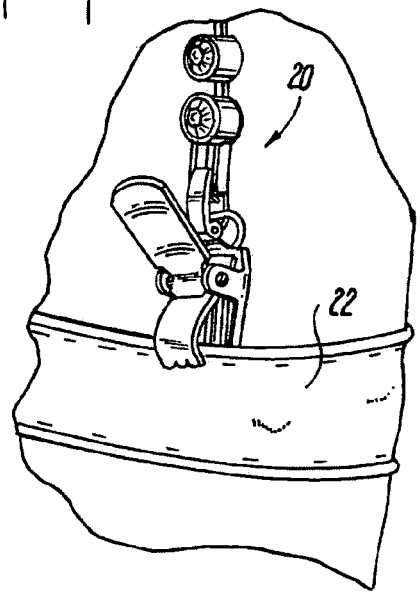
Fig. 3

Fig. 5
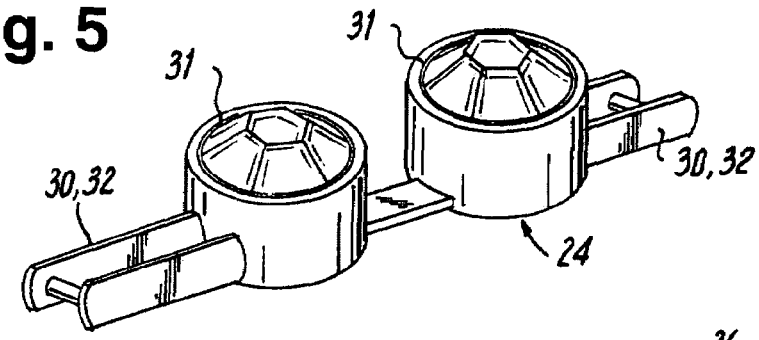
Fig. 6
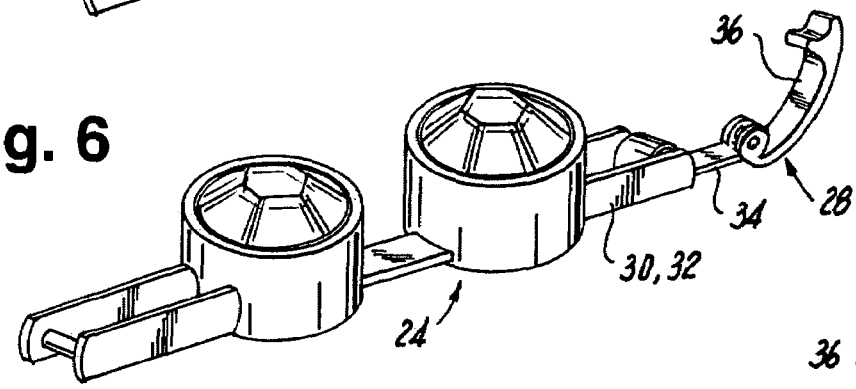
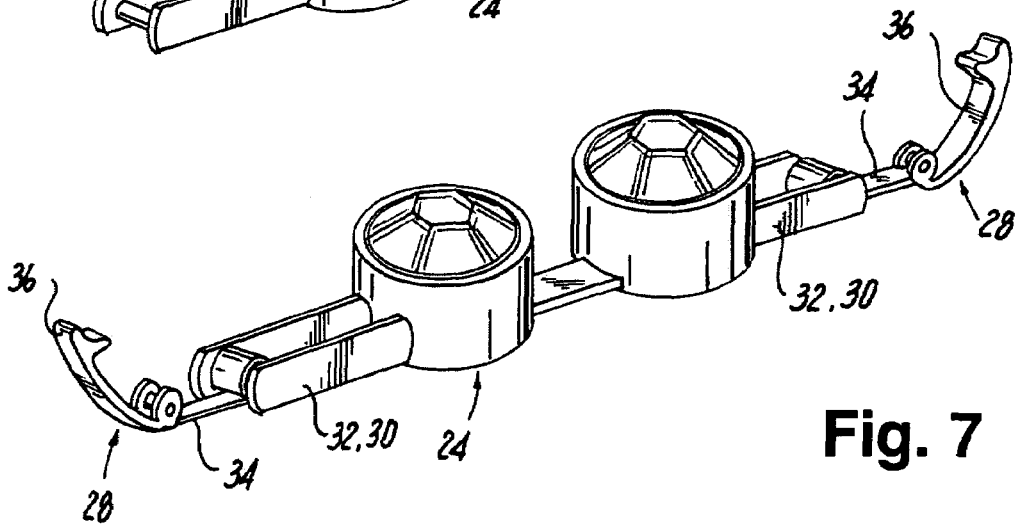
Fig. 7
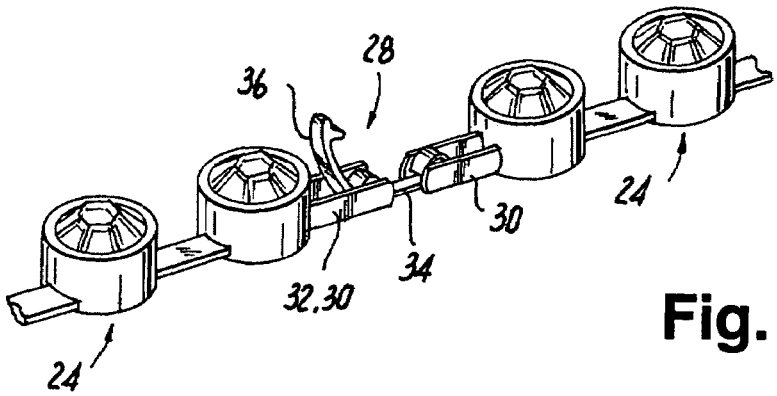
Fig. 8

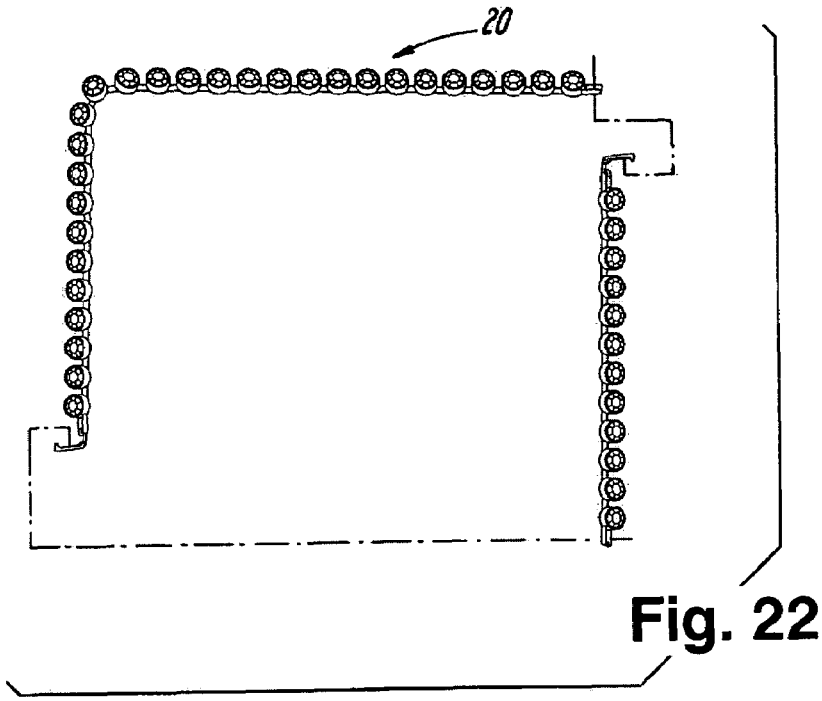
Fig. 22
Fig. 22A
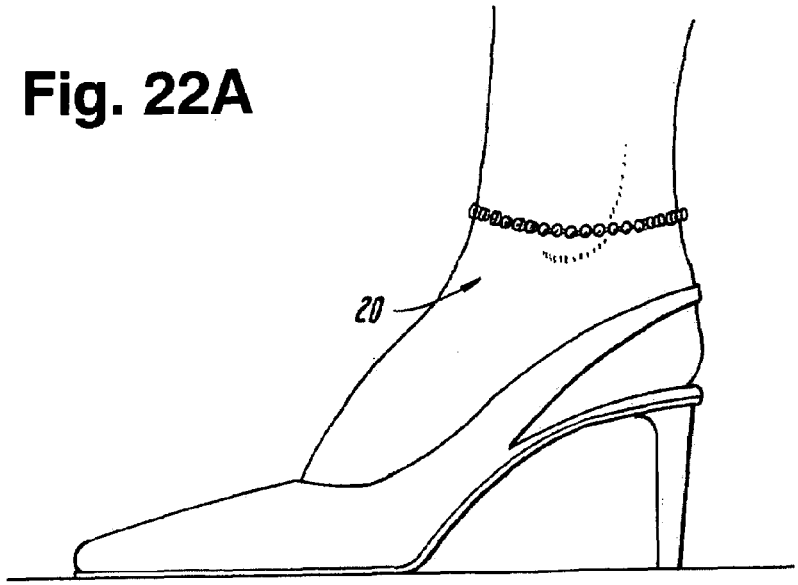

MULTI-FUNCTION JEWELRY CHAIN PRIMARILY FOR SUPPORTING AN UPPER TORSO GARMENT

BACKGROUND OF THE INVENTION

1. Field of the Invention

The present invention relates to a multi-function chain, and more, particularly, the present invention relates to a length adjustable, adaptable and versatile multi-function chain composite for application and use in the apparel, jewelry, and accessory industries.

2. Description of the Prior Art

Numerous innovations for jewelry chains have been provided in the prior art that will be discussed infra. Even though these innovations may be suitable for the specific individual purposes to which they address, they each differ in structure and/or operation and/or purpose from the present invention in that they do not teach a length adjustable, adaptable and versatile, multi-function chain composite for application and use in the apparel, jewelry, and accessory industries.

FOR EXAMPLE, U.S. Pat. No. Des. 296,997 to Dobson teaches the ornamental design for a combined jewelry chain and length adjuster or similar article.

ANOTHER EXAMPLE, U.S. Pat. No. 4,400,932 to Epstein teaches a jewelry link in the form of an elongated loop capable of holding and displaying a number of precious stones and the like. The link has a closed U-shaped ring at one end and a corresponding hole at the other end, so that the ring of one link may be inserted into the hole of an adjacent link. Each link has a deformable hook secured adjacent to the ring-received hole, so that when the U-shaped ring of an adjacent link is inserted in the hole, the two links can be locked together by pressing the deformable hook so that it interlocks with the inserted ring. By this means links can be added to a bracelet or necklace as the wearer is able to purchase them, and in similar fashion additional precious stones can be added to each link as desired.

STILL ANOTHER EXAMPLE, U.S. Pat. No. 4,651,541 to Farley teaches only a jewelry chain separator comprising an elongated rod-like body having opposite end enlargements thereon. At least one additional enlargement is carried by the body spaced equally between the opposite end enlargements and the rod-like body is substantially cylindrical in shape while the enlargements are spherical in shape.

YET ANOTHER EXAMPLE, U.S. Pat. No. 4,815,180 to Elsener teaches a transferable jewelry clasp that can be worn with different chains or bands which has the shape of a ring or has a central opening and has an upper part and a lower part. These parts are connected with one another on one side by means of a hinge, and on the opposite side by means of a snap clasp. It can thus be opened and closed easily. In order to ensure that the jewelry clasp is not lost, two cams directed inwardly toward the central opening are attached to the upper part. Eyelets are attached to the ends of the chain, which are so dimensioned that their internal diameters are larger than the thickness of the jewelry clasp ring and smaller than the thickness of the ring plus the height of the cam. With such dimensioning, the chain and eyelets can only be attached to a position differing from the supporting direction on the upper clasp part, and the danger of loss is avoided, even if the jewelry clasp is opened involuntarily.

STILL YET ANOTHER EXAMPLE, U.S. Pat. No. 6,158,206 to Rosenwasser et al. teaches a double helix jewelry chain that is constructed from a series of interconnected chain links. Each link is formed with an open mouth defined between a pair of end faces. The end faces are aligned with one another in various predetermined geometrical and dimensional relationships in order to maintain a minimum projected gap or clearance opening equal to or less than the major dimension of an elongated cross section of each link.

YET STILL ANOTHER EXAMPLE, U.S. Pat. No. 6,209,306 to Chia et al. teaches a decorative rope chain and a manufacturing process to produce a rope chain in which each link used as a basic building element exhibits a unique visual property, such as surface texture, coloration, attribute, feature, characteristic, shape or other physical appearance. Such unique visual property traits for the succession of links results in a more attractive, fanciful, more delicate and interesting fashion item. In one aspect of the invention, each of the interconnected links has a first side surface exhibiting a first visual property and an opposite second side surface exhibiting a second, perceptively different, visual property. In other aspects of the invention, the side surfaces of the links may have differently colored, textured, or patterned surface portions. In yet another aspect of the invention, each link may have differently shaped portions.

STILL YET ANOTHER EXAMPLE, U.S. Pat. No. 6,250,107 to Visser teaches an expandable chain construction that comprises first and second chain lengths of a monofilament such as nylon fishing line. Each chain length is formed into a series of spaced loops, the loops of the two lengths being of opposite senses. Each loop of each length encircles a portion of the other length lying between a pair of loops. Chain constructions may be interconnected along their lengths to form chains of increased width. The chain constructions are expandable to fit closely but gently about a wearer's limb. The construction can simulate the appearance of tattoo designs.

YET STILL ANOTHER EXAMPLE, U.S. Pat. No. 6,263,658 to Rosenwasser et al. teaches a jewelry rope cain formed of a plurality of interconnected links. Each of the links has an exterior surface and the plurality of the links form the periphery of the chain. The exterior surface of the adjacent links of a pair of opposing groups of such links comprise a diamond cut curved surface. This forms opposing arcuate surfaces on the periphery of the chain. The exterior of the remaining opposing links intermediate of these two groups are uncut. As a result, the periphery of the chain is generally a slight oval in cross sectional configuration.

STILL YET ANOTHER EXAMPLE, U.S. Pat. No. 6,279,171 to Brancato, who is also the inventor in the present application, teaches ornamental jewelry supports for garments, particularly for upper torso garments worm by women such as bras, bikini tops, halters, strapless dresses, and the like. The garment supports are adjustable along their length with adjusting mechanisms that do not result in unsightly overlap of the ornamental lengths of jewelry of the present garment supports, but do, however, require positioning of unused lengths between the garment and the wearer causing discomfort to the wearer and mar the overall appearance of the garment. The adjustable ornamental garment supports can be readily moved from one garment to another and do not required puncturing the garment.

YET STILL ANOTHER EXAMPLE, U.S. Pat. No. 6,339,922 to Foster teaches an improved jewelry chain of a type having a plurality of links. Each link resembles a fish hook and has a shank with one end thereof having a barbed hook thereon and an opposite end thereof having an eyelet thereon which engages the barbed hook of an adjacent link. The eyelet lies in a first plane and the shank and barbed hook lie in a second plane that is perpendicular to the first plane. The improvements include the barbed hook not touching the shank, the eyelet being so sized so as not to allow the barbed hook of an adjacent link to pass there through, except for the eyelet of one terminal link being large enough to allow the barbed hook of the other terminal link to selectively disengage therefrom, and the second plane being arcuate so as to allow each link to lie flat on the skin of the user.

It is apparent that numerous innovations for jewelry chains have been provided in the prior art that are adapted to be used. Even though these innovations may be suitable for the specific individual purposes to which they address, they would not be suitable for the purposes of the present invention as heretofore described, namely a length adjustable, adaptable and versatile, multi-function chain composite for application and use in the apparel, jewelry, and accessory industries.

SUMMARY OF THE INVENTION

BRIEFLY STATED, the present invention provides a length adjustable, multi-function chain composite for use in the apparel, jewelry, and accessory industries. The length adjustable, multi-function chain composite includes at least two chain segments that are separate and independent of each other, and apparatus that is operatively connected to the at least two chain segments and replaceably attaches the at least two chain segments end-to-end collinearly so as to allow the length adjustable, multi-function chain composite to be reconfigurable for being multi-functional.

The novel features which are considered characteristics of the present invention are set forth in the appended claims. The invention itself, however, both as to its construction and its method of operation, together with additional objects and advantages thereof, will be best understood from the following description of the specific embodiments when read and understood in connection with the accompanying drawings.

BRIEF DESCRIPTION OF THE DRAWINGS

The figures of the drawings are briefly described as follows:

FIG. 1 is a diagrammatic perspective view of the length adjustable, multi-function chain composite of the present invention supporting an upper torso garment.

FIG. 2 is an enlarged diagrammatic perspective view of the area generally enclosed by the dotted curve identified by ARROW 2 in FIG. 1 of the length adjustable, multi-function chain composite functioning as support for an upper torso garment in FIG. 1 by engaging a front portion of the upper torso garment;

FIG. 3 is an enlarged diagrammatic perspective view of the area generally enclosed by the dotted curve identified by ARROW 3 in FIG. 1 of the length adjustable, multi-function chain composite functioning as support for an upper torso garment in FIG. 1 by engaging a rear portion of the upper torso garment;

FIG. 5 is an enlarged diagrammatic perspective view of the area generally enclosed by the dotted curve identified by ARROW 5 in FIG. 4 of a chain segment with a terminal loop on both terminal ends of the length adjustable multi-function chain composite of the present invention shown in FIG. 4;

FIG. 6 is an enlarged diagrammatic perspective view of the area generally enclosed by the dotted curve identified by ARROW 6 in FIG. 4 of the chain segment with a primary clasp on one terminal end thereof and a terminal loop on the other terminal end of the length adjustable, multi-function chain composite of the present invention shown in FIG. 4;

FIG. 7 is an enlarged diagrammatic perspective view of the area generally enclosed by the dotted curve identified by ARROW 7 in FIG. 4 of a chain segment with a primary clasp on each terminal end thereof of the length adjustable, multi-function chain composite of the present invention shown in FIG. 4.

FIG. 8 is an enlarged diagrammatic perspective view of the area generally enclosed by the dotted curve identified by ARROW 8 in FIG. 4 of a chain segment with a primary clasp on one end thereof engaging one end of an adjacent chain segment of the length adjustable, multi-function chain composite of the present invention shown in FIG. 4.

FIG. 22 is a diagrammatic plan view with parts separated of the components of a length adjustable, multi-function chain composite functioning as a decorative ankle bracelet;

FIG. 22A is a side elevation of the assembled length adjustable, multi-function chain composite of FIG. 22 installed as a decorative ankle bracket on a user;

LIST OF REFERENCE NUMERALS UTILIZED IN THE DRAWING

Figure 1A:
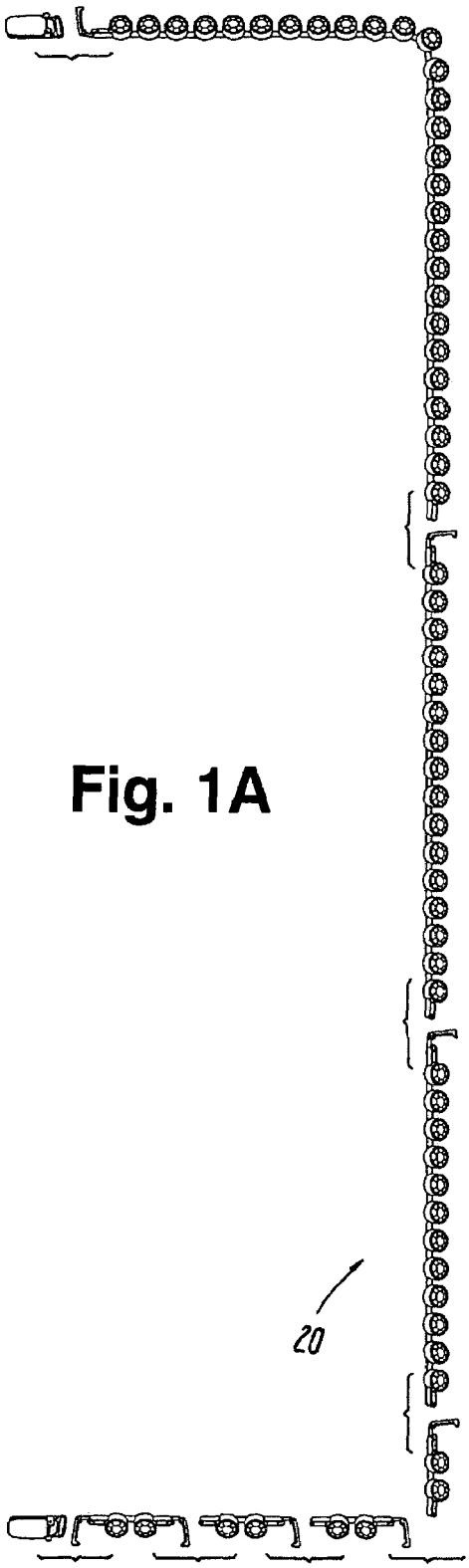
FIG. 1A is a diagrammatic plan view with parts separated of the components of a length adjustable, multi-function chain composite functioning as a decorative bra strap for the left shoulder.
Figure 1B:
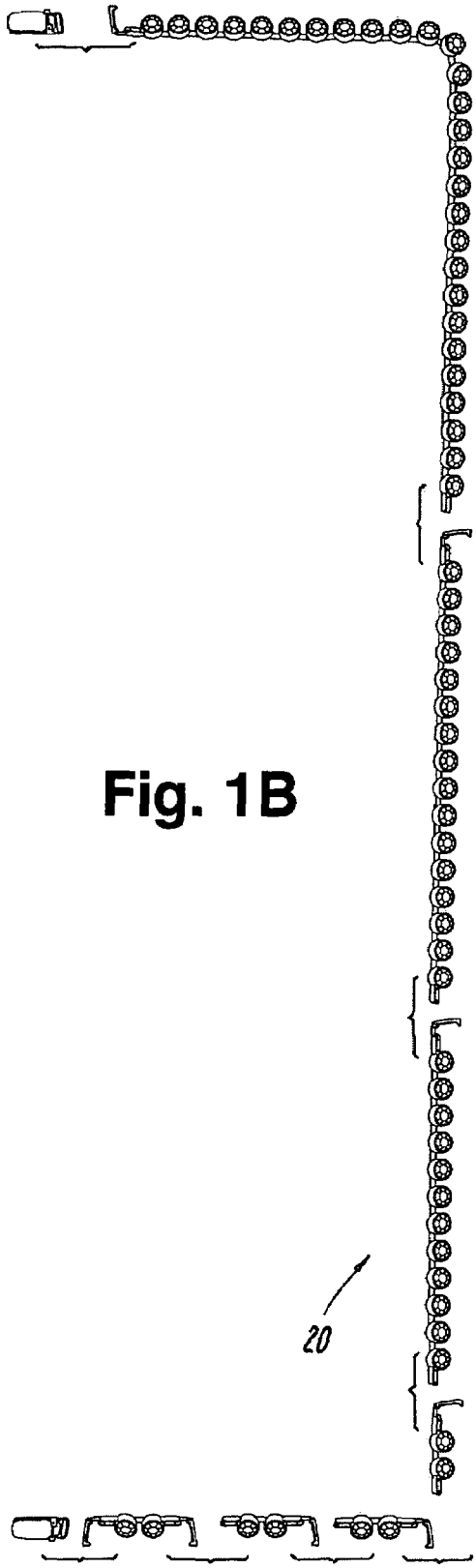
FIG. 1B is a diagrammatic plan view with parts separated of the components of a length adjustable, multi-function chain composite functioning as a decorative bra strap for the right shoulder.
Figure 1C:
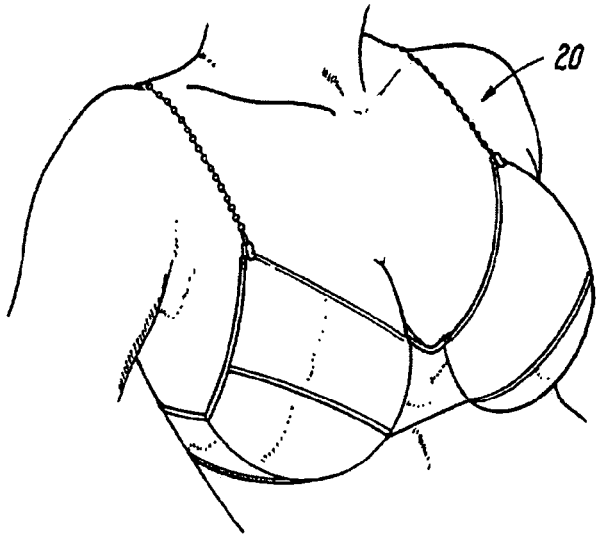
FIG. 1C is a perspective view of the length adjustable, multi-function chain composites of FIG. 1A and FIG. 1B installed as decorative bra straps on a typical bra worn by a user.

20 length adjustable, multi-function chain composite of present invention
22 upper torso garment
23 pair of terminal ends
24 plurality of chain segments
26 secondary clasp for releaseably attaching multi-function chain 20 to upper torso garment 22
28 at least one primary clasp
30 pair of terminal ends of each length adjustable, multi-function chain composite of plurality of chain segments 24
31 plurality of links of each length adjustable, multi-function chain composite of plurality of chain segments 24
32 loops of pair of terminal ends 30 of each length adjustable, multi-function chain composite of plurality of chain segments 24
34 first leg of each primary clasp of at least one primary clasp 28
36 second leg of each primary clasp of at least one primary clasp 28
38 stationary jaw of secondary clasp 26
40 movable jaw of secondary clasp 26
42 spring of secondary clasp 26
44 finger grip of secondary clasp 26
46 loop of secondary clasp 26

DETAILED DESCRIPTION OF THE PREFERRED EMBODIMENT

The present invention in use is generally set forth in FIG. 1, FIG. 1C, FIG. 2B, FIG. 3B, FIG. 3C, FIG. 11, FIG. 12, FIG. 13, FIG. 15, FIG. 16, FIG. 18, FIG. 20A, FIG. 21A, FIG. 22A, FIG. 23A, FIG. 24A, and FIG. 25A. It is a length adjustable, multi-function chain composite 20 that is versatile and adaptable for use by different people in different ways in different applications in the apparel, jewelry, and accessory industries. It comprises at least two chain segments 24 separate from and independent of each other, and at least one primary clasp 28. Its length will vary and depend on the specific application in connection with which it will be used. Various lengths of the length adjustable, multi-function chain composite 20 are set forth in more detail below and in the accompanying drawings.

The length adjustable, multi-function chain composite 20 further can be comprised of a precious metal, a decorative stone, a semi-precious metal, a precious gem, a semi-precious gem, an artificial gem, a pearl, an ornamental clip, a diamond, a bead, and combinations thereof, in various designs, shapes, colors, and combinations thereof. The length adjustable, multi-function chain composite 20 can be also comprised of material or fabric, such as satin, silk, velvet, etc.

Each chain segment 24 comprises a plurality of chain links 31, which are interconnected and linked together in a known fashion. The plurality of chain links 31 can be traditional links known in the jewelry industry. The plurality of chain links 31 can be made of fabric and/or metals, such as copper, brass, silver, gold, platinum, titanium, or any other metals known in the apparatus, jewelry, and accessorizing industry for use in connection with straps and jewelry chains. Further, the plurality of chain links 31 can be formed and equipped in a manner known in the art to carry decorative stones, beads, pearls, precious stones and gems, semi precious stones and gems, artificial gems, crystals, stone beads, glass beads, and any other materials now known or hereafter developed. Each of the chain segments 24 is separate from and independent of the other. Furthermore, the at least two chain segments 24 can either be of the sample length or vary in length from chain segment to chain segment.

Each chain segment 24 also comprises a pair of terminal ends 30. The plurality of links 31 of each chain segment 24 are axially movably and flexibly attached to each other end-to-end so as to allow each chain segment 24 to conform to the body part on which it is placed. The pair of terminal ends 30 of each chain segment 24 can have loops 32 thereat, respectively.

The specific configuration of the primary clasp 28 and its interface with a chain segment 24 can best be seen in FIGS. 6-8, and as such, will be discussed with reference thereto.

The primary clasp 28 comprises a first leg 34 and a second leg 36. The first leg 34 of the primary clasp 28 pivotally engages one loop 32 of the chain segment 24 as shown in FIG.

6 or both loops 32 of the chain segment 24 as shown in FIG. 7. The second leg 36 of the primary class 28 is pivotally attached to the first leg 34 thereof.

As shown in FIG. 8, the second leg 36 of the primary clasp 28 on a terminal end 30 of one chain segment 24 passes through the loop 32 on a terminal end 30 of an adjacent chain segment 24 and pivots back towards, and fictionally/compressibly engages, the first leg 34 thereof, and in doting so, captures the loop 32 on the terminal end 30 of the adjacent chain segment 24 so as to releasably attach the one chain segment 24 to the adjacent chain segment 24 when the primary clasp 28 is used to replaceably attach chain segments 24 together end-to-end collinearly, preferably without a need for tools, or to replaceably attach length adjustable, multi-function chain composites 20 together end-to-end collinearly, preferably without a need for tools. Thus, the primary clasp 28 replaceably attaches adjacent chain segments 24 to each other end-to-end collinearly, preferably without a need for tools.

It must be noted that the primary clasp 28 is the preferred clasp to use in the length adjustable, multi-function chain composite 20 as it provides for the most elegant appearance. Any other clasp, however, can be used as well provided it has the ability to remove and add chain segments as is required by the length adjustable multi-function chain composite of the present invention.

Figure 3A:
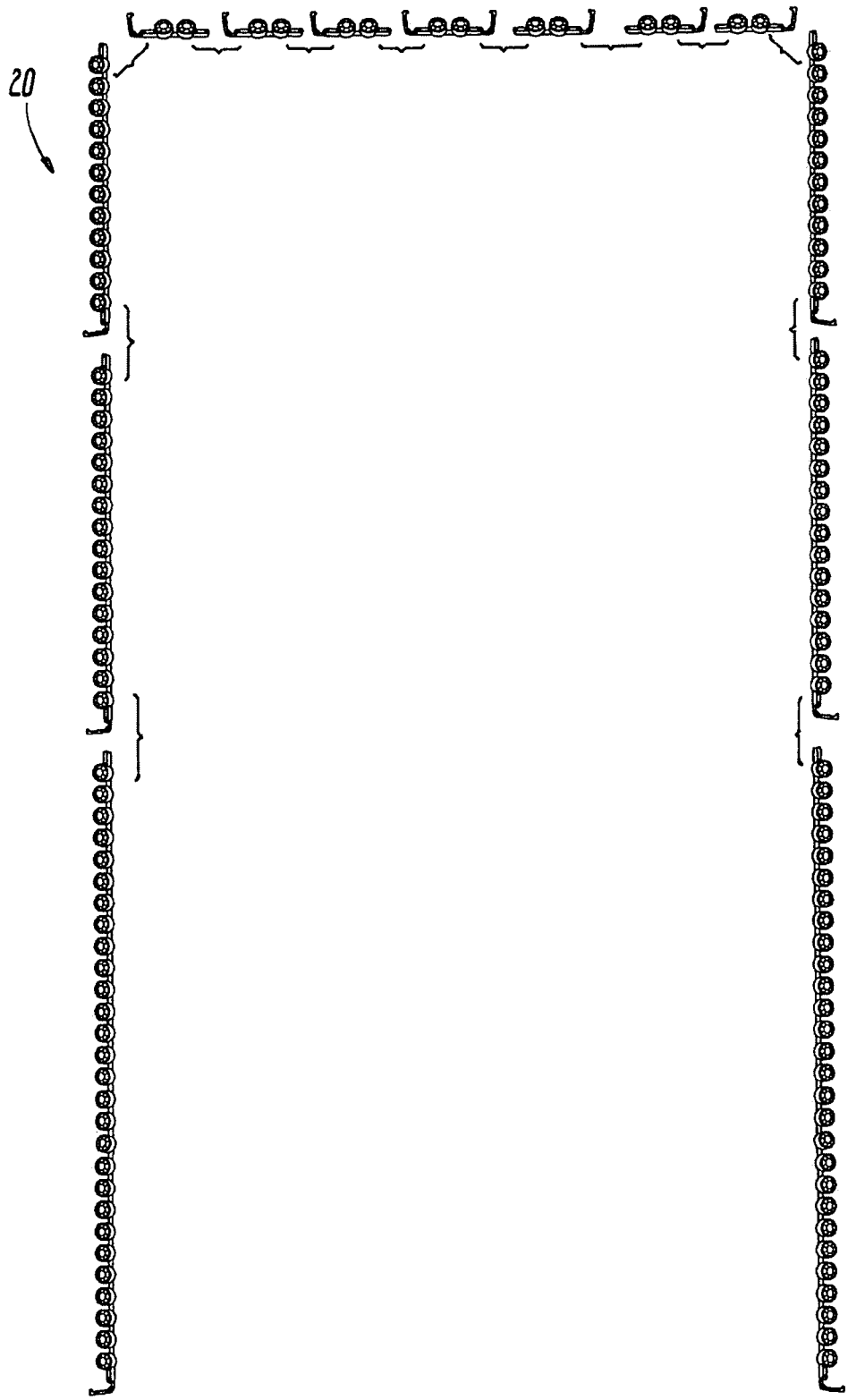
FIG. 3A is a diagrammatic plan view with parts separated of the components of a length adjustable, multi-function chain composite functioning as a decorative purse or handbag strap or halter bra strap.
Figure 3B:
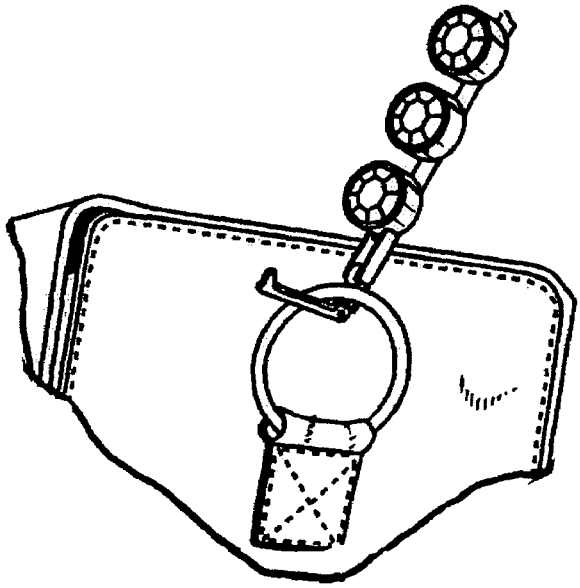
FIG. 3B is a local perspective view of the primary fastening clasp of the length adjustable, multi-function chain composite of FIG. 3A installed as a decorative purse or handbag strap, in relation to an attachment loop affixed to the purse or bag.
Figure 3C:
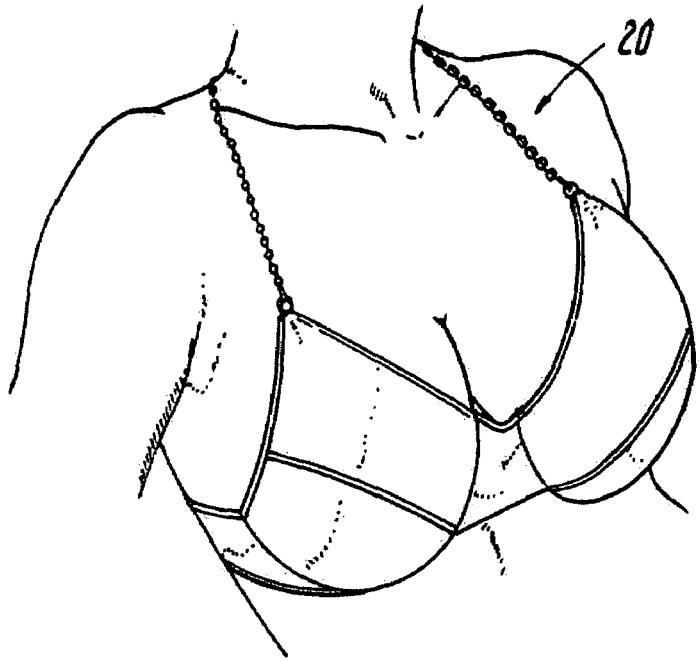
FIG. 3C is a local perspective view of the length adjustable, multi-function chain composite of FIG. 3A installed as a decorative halter bra strap on a typical bra worn by a user, in relation to an attachment loop affixed to the bar.

The length adjustable, multi-function chain composite 20, once formed by the combination of the chain segments 24 and the at least one primary clasp 28, as set forth herein above, also comprises a pair of terminal ends 23. Each of the terminal ends 23 can be provided with any way known in the apparel, jewelry, and accessory industries for attachment of straps, chains, handles, belts, etc. to items. Such a way can be a clasp of any shape or size as shown in FIG. 3B, the primary clasp 28 discussed above, or a clasp of any sort so as to provide a connecting mechanism. Or in the alternative, the terminal ends 23 can be permanently attached to the item in connection with which the length adjustable, multi-function chain composite 20 is being used.

In an embodiment capable of delivering maximum versatility, interchangeability, and adaptability, each of the terminal ends 23 is connected to a secondary clasp 26 via a primary clasp 28, preferably without a need for tools. The pair of primary clasps 28 replaceably attach the pair of secondary clasps 26 to the pair of terminal ends 23 of the length adjustable, multi-function chain composite 20, respectively, when used. Further, as discussed above, additional primary clasps 28 replaceabley attach the plurality of chain segments 24 to each other end-to-end collinearly, preferably without a need for tools.

The secondary clasp 26, when in place, permits the attachment of the length adjustable, multi-function chain composite 20 to any item in connection with which it is being used without any modification to the item, as for example, by supplying the item with hooking loops. Furthermore, such attachment occurs without piercing, puncturing, damaging, or otherwise marring or detracting from the appearance of the item. Further, the appearance of the secondary clasp 26 can be further enhanced in such a fashion as to cause the secondary clasp 26 to greatly and positively contribute to and enhance the overall artistic impression of the item in connection with which it is being used.

Figure 9:
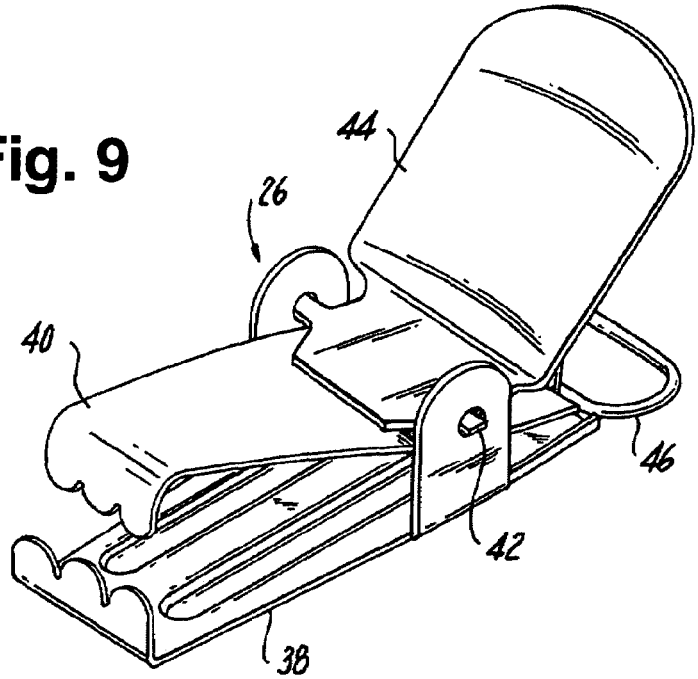
FIG. 9 is an enlarged diagrammatic perspective view of the area generally enclosed by the dotted curved identified by ARROW 9 in FIG. 4 of a secondary clasp of the length of adjustable, multi-function chain composite of the present invention shown in FIG. 4.

The specific configuration of the secondary clasp 26 can best be seen in FIG. 9, which is an enlarged diagrammatic perspective view of the area generally enclosed by the dotted curve identified by ARROW 9 in FIG. 4 of a secondary clasp of the length adjustable, multi-function chain composite of the present invention shown in FIG. 4, and as such, will be discussed with reference thereto.

The secondary clasp 26 comprises a stationary jaw 38, a movable jaw 40, a spring 42, a finger grip 44, and a loop 46. The movable jaw 40 of the secondary clasp 26 is pivotally attached to the stationary jaw 38 thereof, and is biased there towards by the spring 42 thereof. The finger grip 44 of the secondary clasp 26 extends rearwardly from the movable jaw 40 thereof, and the loop 46 of the secondary clasp 26 extends rearwardly from the stationary jaw 38 thereof.

Figure 10:
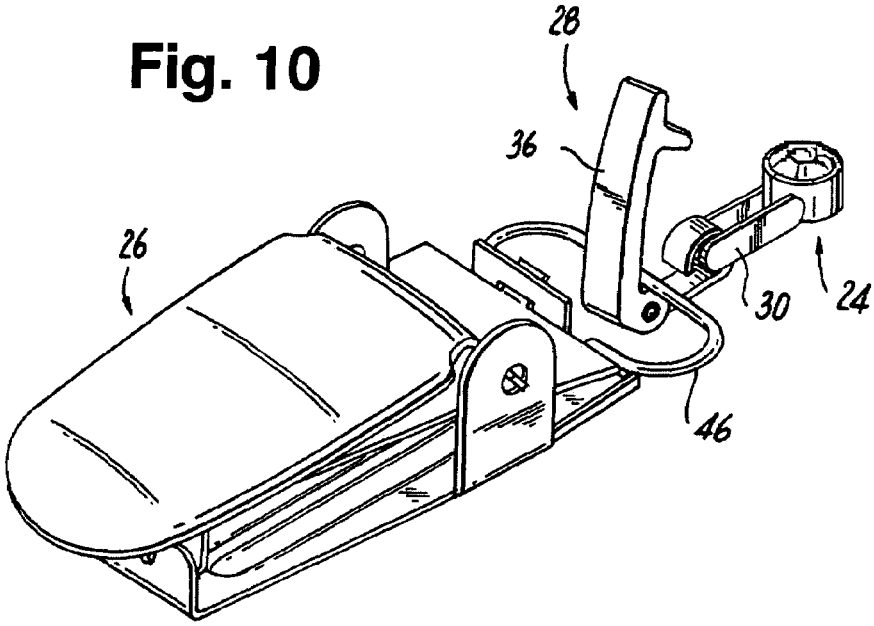
FIG. 10 is an enlarged diagrammatic perspective view of the area generally enclosed by the dotted curve identified by ARROW 10 in FIG. 4 of a chain segment with a secondary clasp on one end thereof of the length adjustable, multi-function chain composite of the present invention shown in FIG. 4.

The interface of a secondary clasp 26 with a chain segment 24 by way of a primary clasp 28 can best be seen in FIG. 10, which is an enlarged diagrammatic perspective view of the area generally enclosed by the dotted curve identified by ARROW 10 in FIG. 4 of a chain segment with a secondary clasp on one end thereof of the length adjustable, multi-function chain composite of the present invention shown in FIG. 4, and as such, will be discussed with reference thereto.

The second leg 36 of the primary clasp 28 on a terminal end 30 of a chain segment 24 passes through the loop 46 of the secondary clasp 26 and pivots back towards, and frictionally/compressingly engages, the first leg 34 thereof capturing the loop 46 of the secondary clasp 26, and in doing so, releaseably attaches the secondary clasp 26 to the chain segment 24 when the primary clasp 28 is used to replaceably attach the secondary clasp 26 to the chain segment 24.

It is noted that the secondary clasp 26 is the preferred clasp to use in the length adjustable, multi-function chain composite as it provides for the most elegant appearance. Any other clasp, or clasp type or closure type mechanism, however, can be used as well. Or in the alternative, the secondary clasp 26 can be removed altogether and the primary clasp 28 used alone so long as a mechanism is attached to the item for the latching of the primary clasp 28 thereto.

Figure 2B:
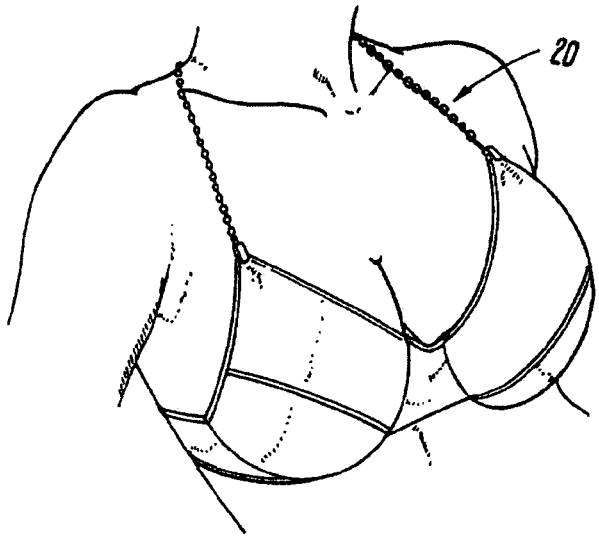
FIG. 2B is a perspective view of the length adjustable, multi-function chain composite of FIG. 2A installed as a decorative halter bra strap on a typical bra worn by a user.
Figure 2A:
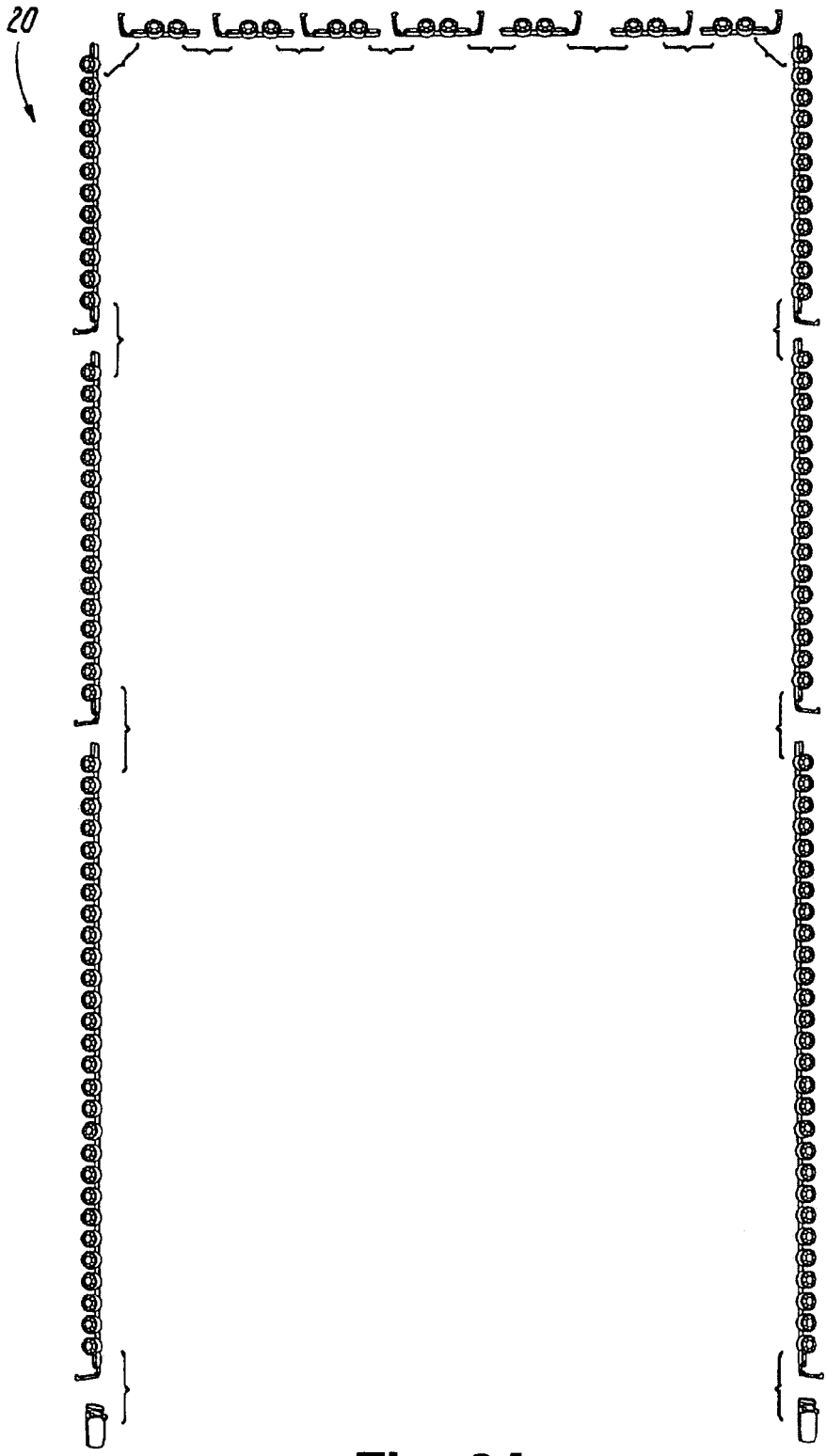
FIG. 2A is a diagrammatic plan view with parts separated of the components of a length adjustable, multi-function chain composite functioning as a decorative halter bra strap.
Figure 11:
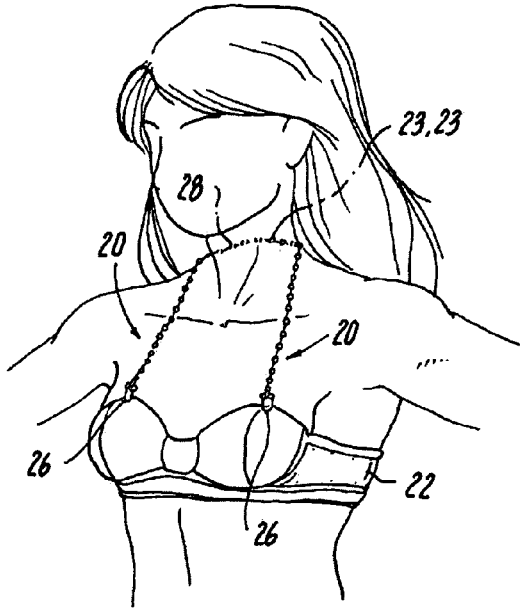
FIG. 11 is a diagrammatic perspective view of one configuration in which the length adjustable, multi-function chain composite of the present invention shown in FIG. 4 supports an upper torso garment.

It is understood from the description of the components of the length adjustable multi-function chain composite set forth above that the various chain segments can vary in length themselves and the respective clasps can be assembled in any number of ways to form any number of length adjustable, multi-function chain composites adaptable for use by different people, in different ways, in different applications in the apparel, jewelry, and accessory industries. Some of the applications are as follows:

FIGS. 2A, 2B, and 11 show one example of an application of the length adjustable, multi-function chain composite 20 in the apparel industry. It is used primarily for supporting an upper torso garment by having one terminal end 23 of one length adjustable, multi-function chain composite 20 attached to one terminal end 23 of an adjacent, length adjustable, multi-function chain composite 20 by a primary clasp 28, and suspended from around the neck of the wearer over the front of the wearer, with the other terminal end 23 of the one length adjustable, multi-function chain composite 20 replaceably attached to the front of the upper torso garment 22 by a secondary clasp 26 and the other terminal end 23 of the adjacent, length adjustable, multi-function chain composite 20 replaceably attached to the front of the upper torso garment 22 by another secondary clasp 26 so as to form a halter.

Figure 4:
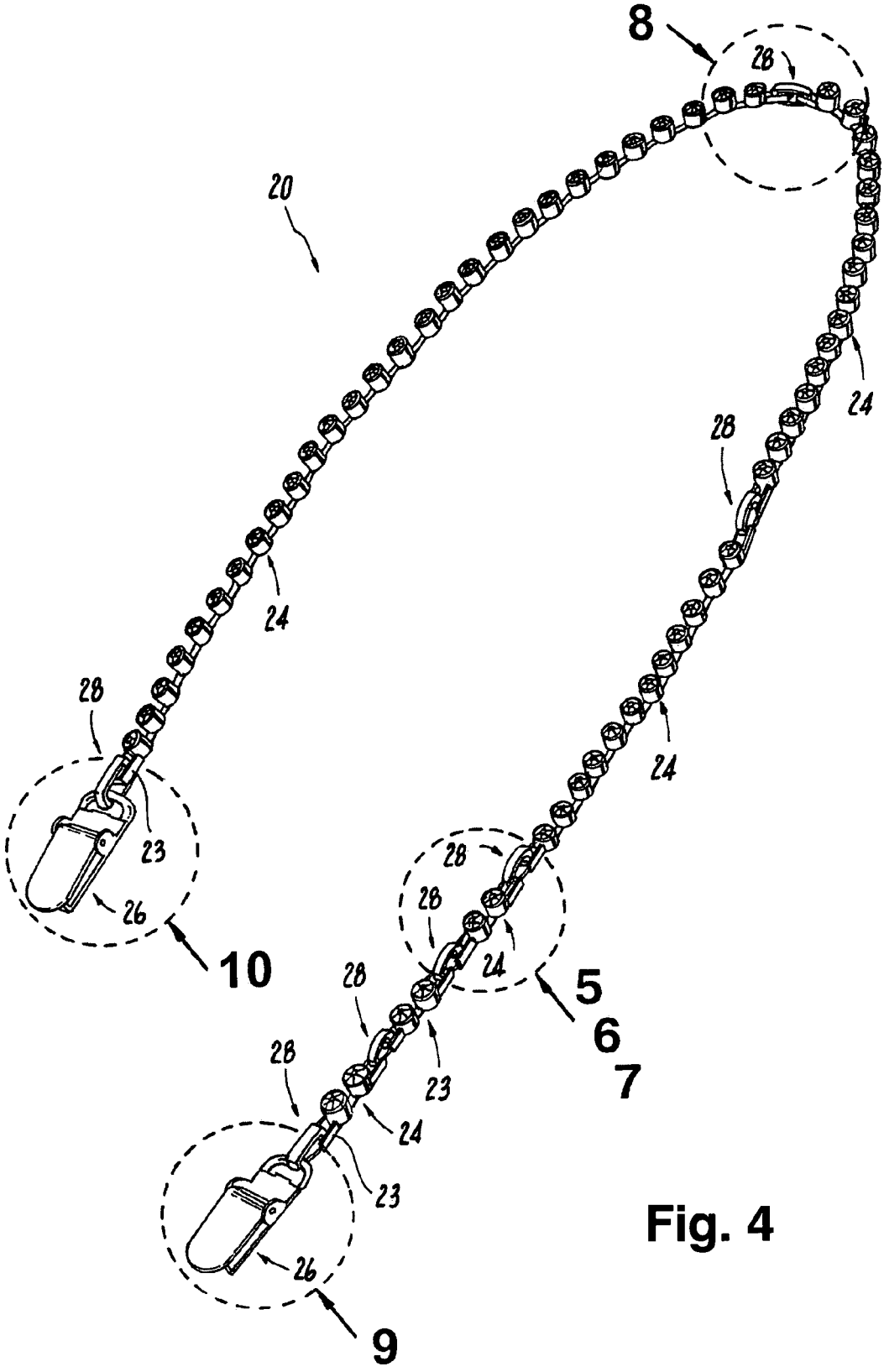
FIG. 4 is an enlarged diagrammatic perspective view of the area generally enclosed by the dotted curve identified by ARROW 4 in FIG. 1 of the length adjustable, multi-function chain composite of the present invention shown in FIG. 1.
Figure 12:
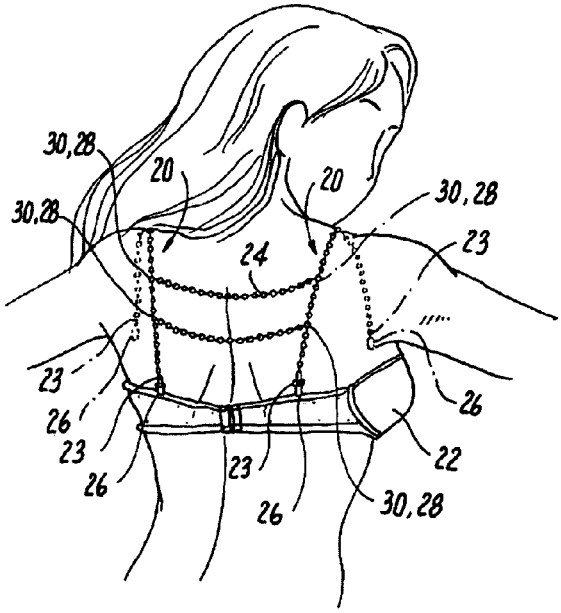
FIG. 12 is a diagrammatic perspective view of another configuration in which the length adjustable, multi-function chain composite of the present invention shown in FIG. 4 supports an upper torso garment.

As shown in FIG. 12 which is a diagrammatic perspective view of another configuration in which the length adjustable, multi-function chain composite of the present invention shown in FIG. 4 supports an upper torso garment, one terminal end 23 of one length adjustable, multi-function chain composite 20 is attached to the front of the upper torso garment 22 by a secondary clasp 26, and the other terminal end 23 of the one length adjustable, multi function chain composite 20 is attached to the rear of the upper torso garment 22 by another secondary clasp 26 so as to form a first shoulder strap. One terminal end 23 of another length adjustable, multi function chain composite 20 is attached to the front of the upper torso garment 22 by a secondary clasp 26, and the other terminal end 23 of the another length adjustable, multi function chain composite 20 is attached to the rear of the upper torso garment 22 by another secondary clasp 26 so as to form a second shoulder strap. A terminal end 30 of a first chain segment 24 is attached to the one length adjustable, multi function chain composite 20 by a primary clasp 28, with the first chain segment 24 extending transversely across the back of the wearer to the another length adjustable, multi function chain composite 20, where the other terminal end 30 of the first chain segment 24 is attached to the another length adjustable, multi function chain composite 20 by another primary clasp 28. A terminal end 30 of a second chain segment 24 is attached to the one length adjustable, multi function chain composite 20 by another primary clasp 28, with the second chain segment 24 extending transversely across the back of the wearer, below the first chain segment 24, to the another length adjustable, multi function chain composite 20, where the other terminal end 30 of the second chain segment 24 is attached to the another length adjustable, multi function chain composite 20 by another primary clasp 28.

Figure 13:
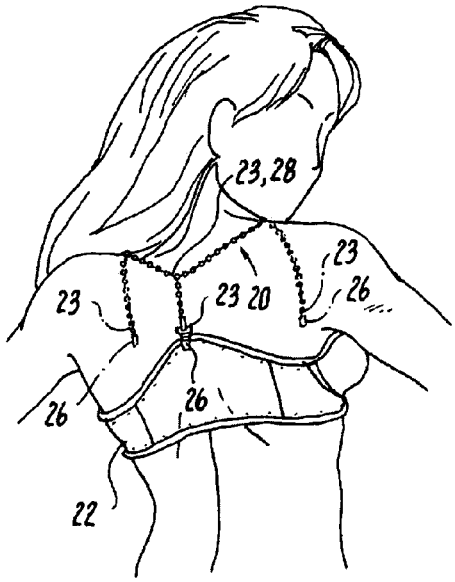
FIG. 13 is a diagrammatic perspective view of still another configuration in which the length adjustable, multi-function chain composite of the present invention shown in FIG. 4 supports an upper torso garment.

A further application of the length adjustable, multi-function chain composite 20 is shown in FIG. 13, which is a diagrammatic perspective view of still another configuration in which the length adjustable, multi-function chain composite of the present invention shown in FIG. 4 supports an upper torso garment, wherein one terminal end 23 of one length adjustable, multi-function chain composite 20 is attached to the front of the upper torso garment 22 by a secondary clasp 26, and the other terminal end 23 of the one length adjustable, multi-function chain composite 20 is attached to the rear of the upper torso garment 22 by another secondary clasp 26 so as to form a first shoulder strap. One terminal end 23 of another length adjustable, multi-function chain composite 20 is attached to the front of the upper torso garment 22 by a primary clasp 26, and the other terminal end 23 of the another length adjustable, multi-function chain composite 20 is attached to an intermediate point of the one length adjustable, multi-function chain composite 20 on the back of the wearer by a primary clasp 28 so as to form a second should strap and a Y-configuration along the back of the wearer.

As can be seen from the embodiments described herein above, not only can the length adjustable, multi-function chain composite 20 be adjusted for length by either adding or removing chain segments 24 or composite chains 20, but they can also be adjusted to accessorize accordingly.

Figure 14:
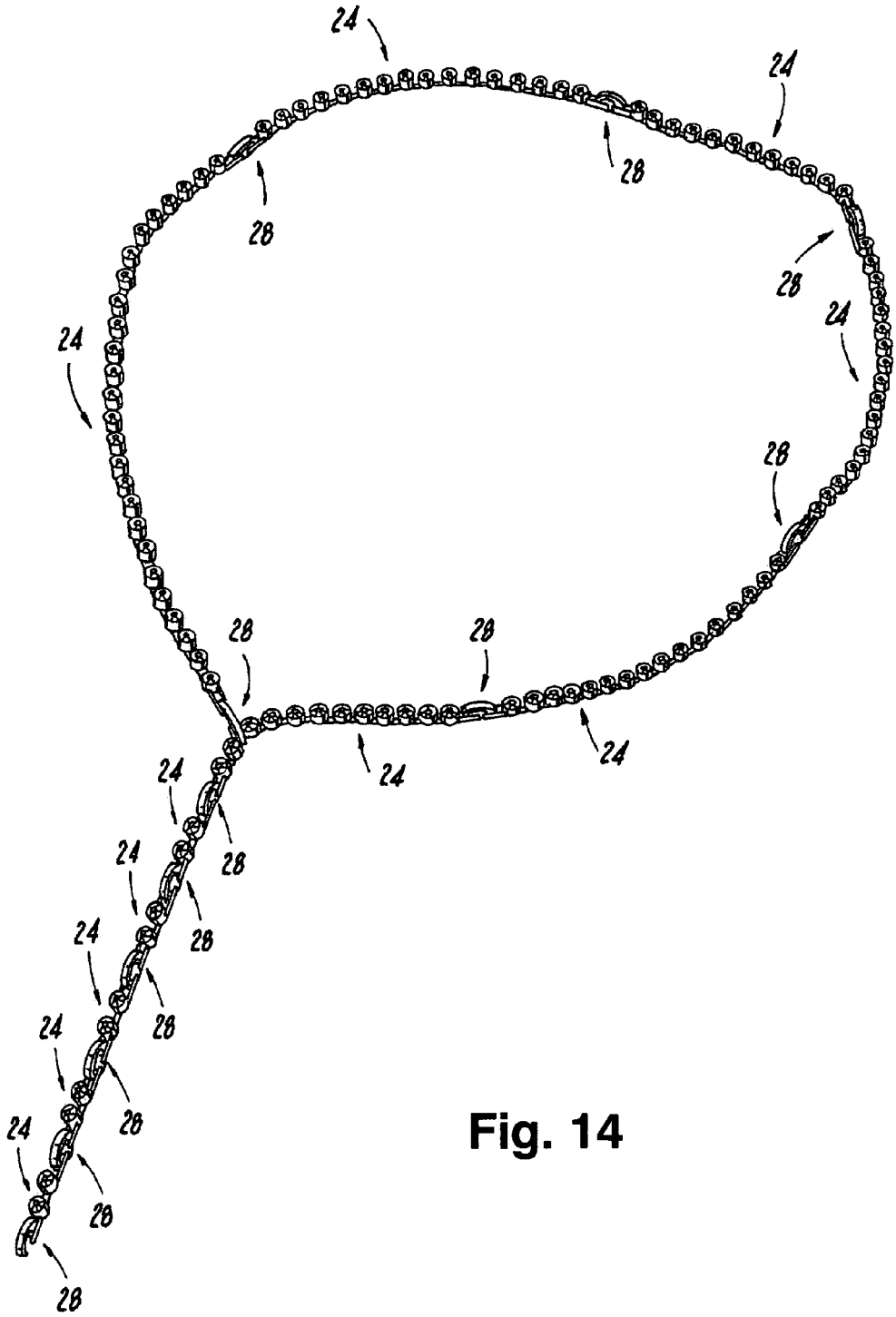
FIG. 14 is a diagrammatic perspective view of a plurality of chain segments used as a belt.
Figure 15:
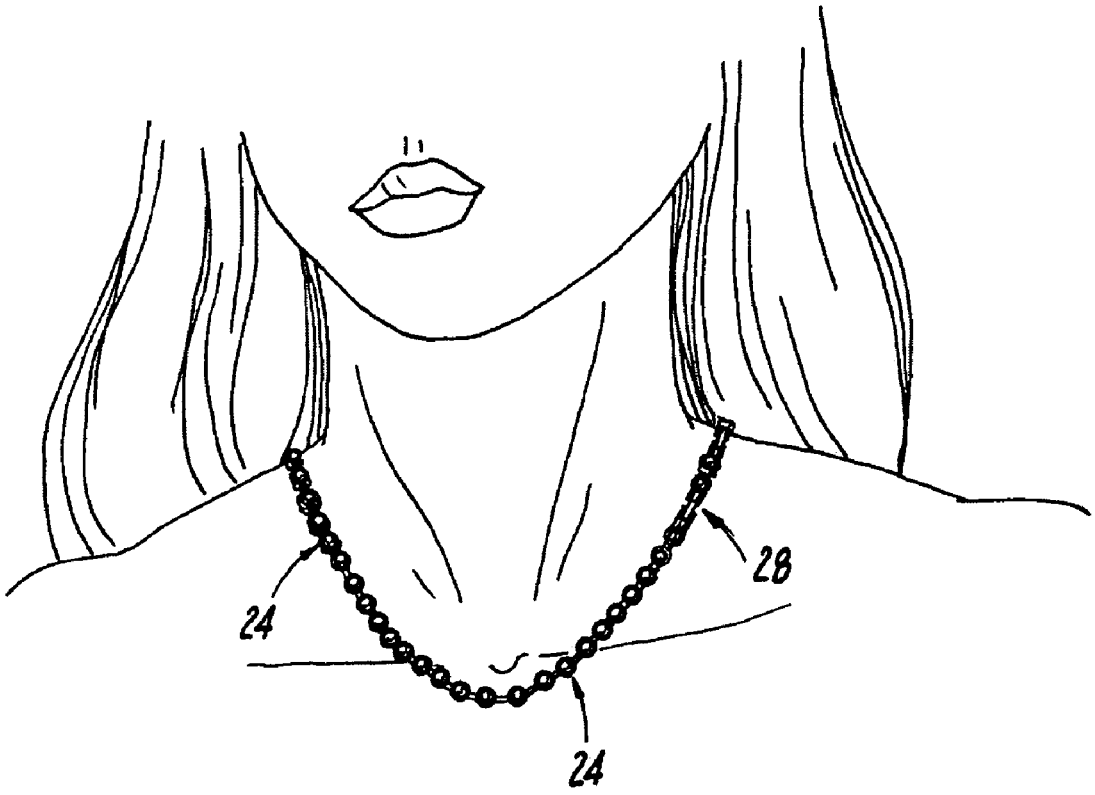
FIG. 15 is a diagrammatic perspective view of a plurality of chain segments used as a necklace.
Figure 16:
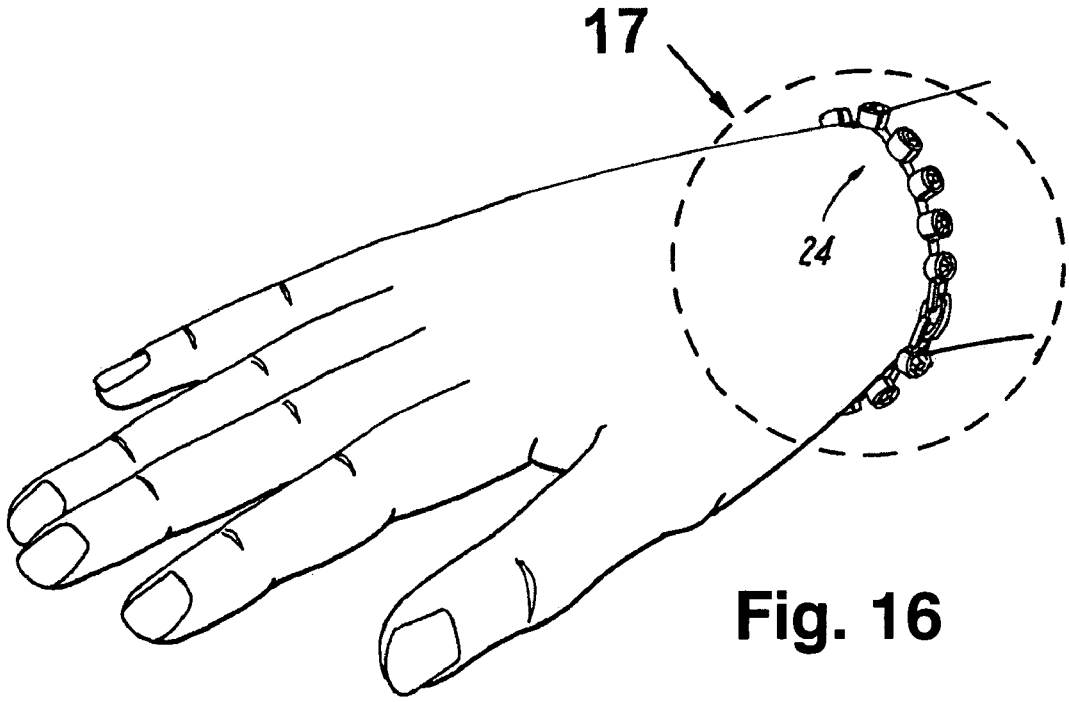
FIG. 16 is a diagrammatic perspective view of a plurality of chain segments used as a bracelet.
Figure 17:
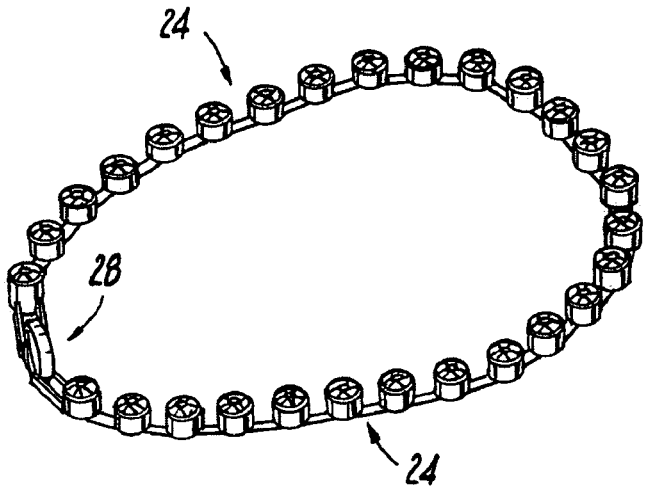
FIG. 17 is a diagrammatic perspective view of the area generally enclosed by the dotted curve identified by ARROW 17 in FIG. 16 of a chain segment formed into a bracelet.
Figure 18:
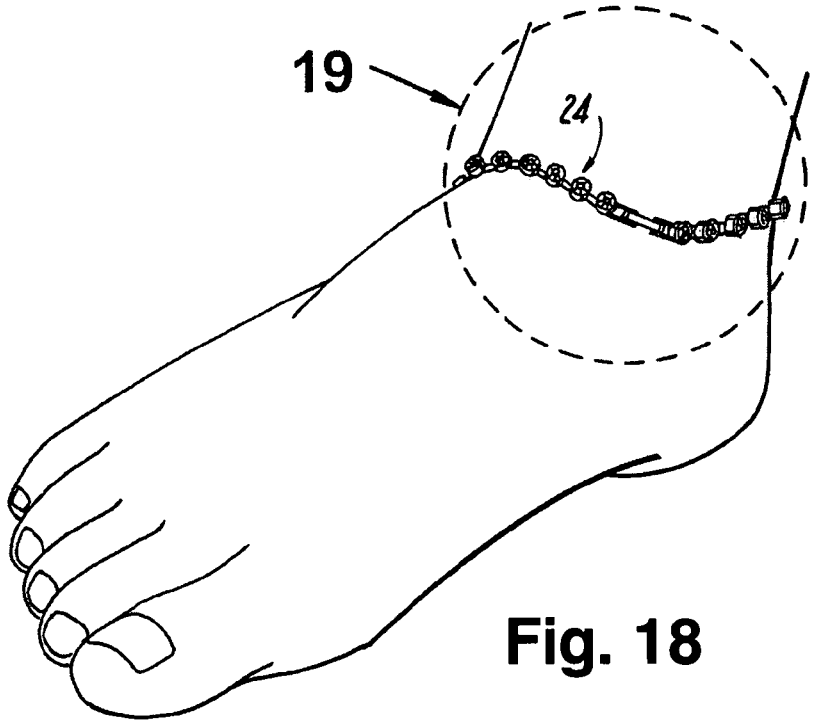
FIG. 18 is a diagrammatic perspective view of a plurality of chain segments used as an ankle bracelet.
Figure 19:
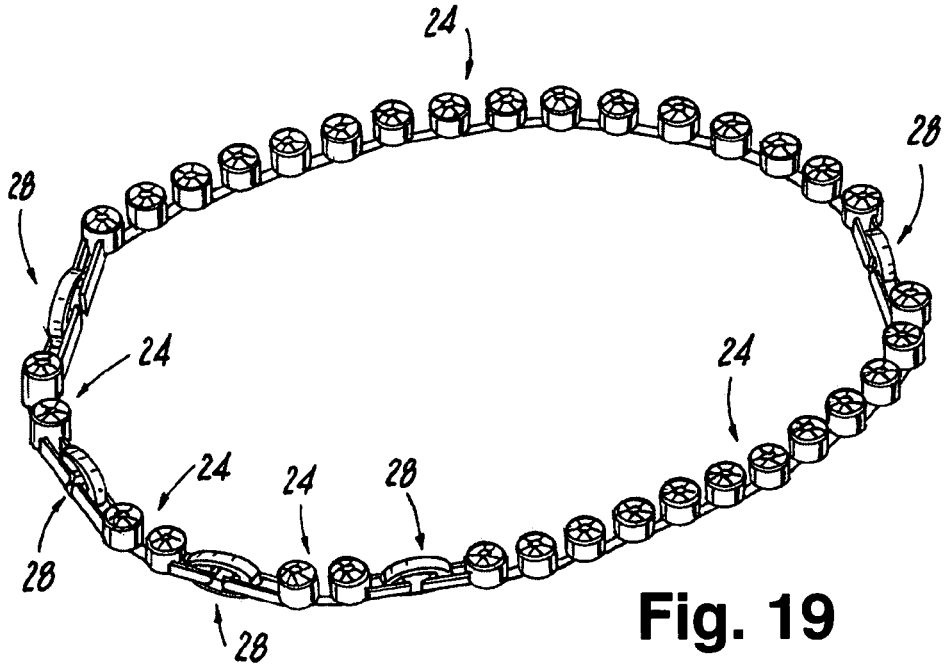
FIG. 19 is a diagrammatic perspective view of the area generally enclosed by the dotted curve identified by ARROW 19 in FIG. 18 of a plurality of chain segments formed into an ankle bracelet.
Figure 20:
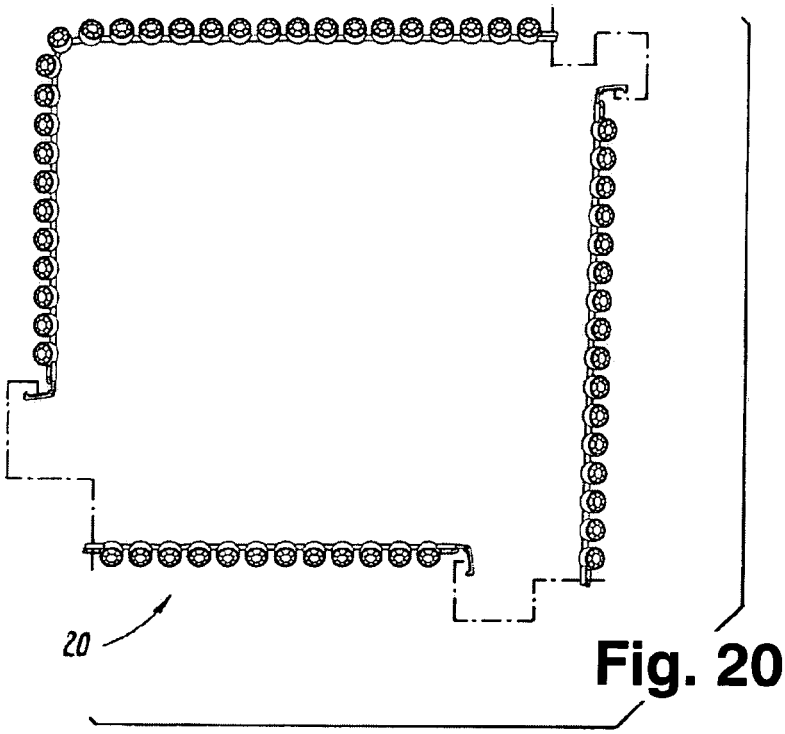
FIG. 20 is a diagrammatic plan view with parts separated of the components of a length adjustable, multi-function chain composite functioning as a decorative necklace.
Figure 20A:
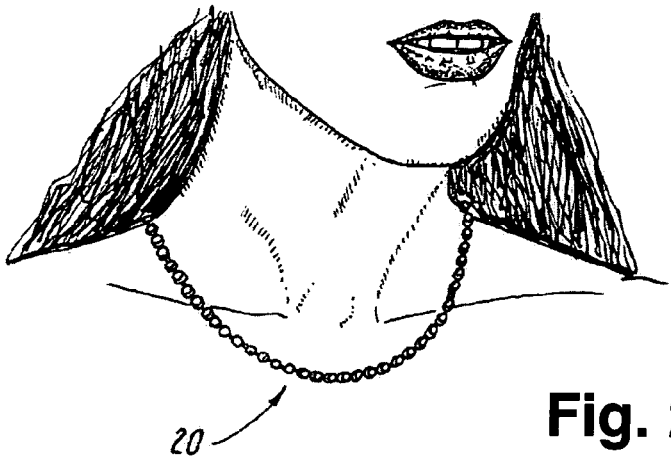
FIG. 20A is a perspective view of the assembled length adjustable, multi function chain composite of FIG. 20 installed as a decorative necklace on a user.
Figure 21:
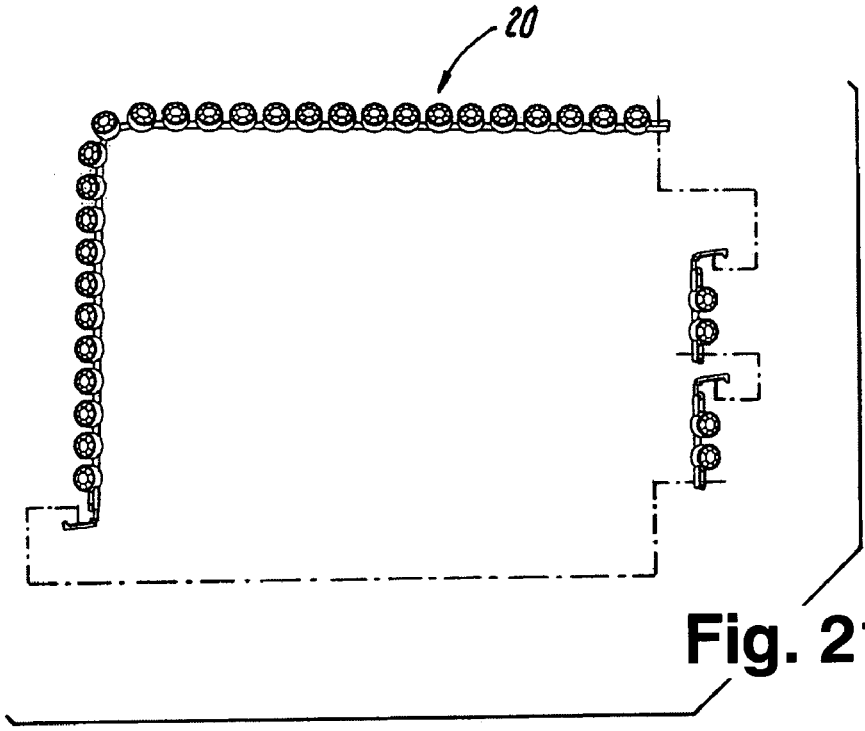
FIG. 21 is a diagrammatic plan view parts separated of the components of a length adjustable, multi-function chain composite functioning as a decorative wrist bracelet.
Figure 21A:
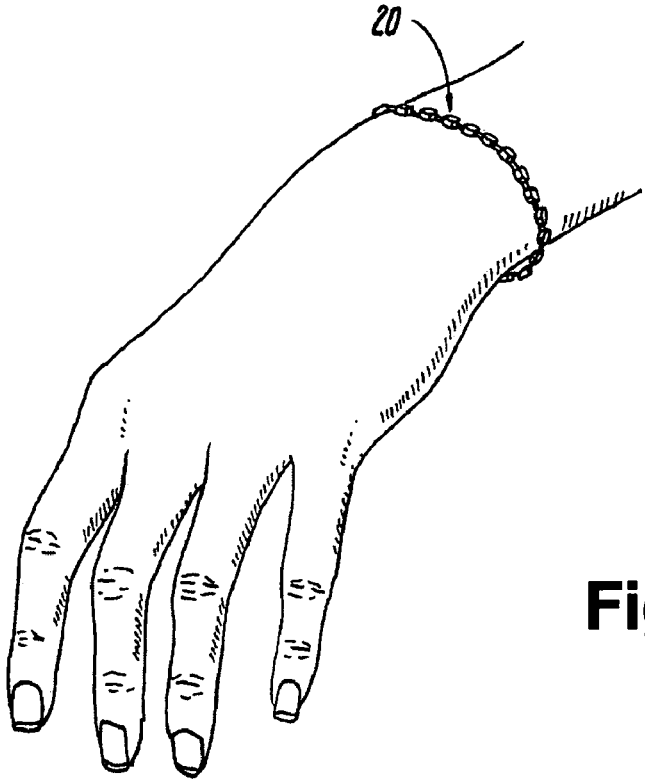
FIG. 21A is a perspective view of the assembled length adjustable, multi-function chain composite of FIG. 21 installed as a decorative wrist bracelet on a user.
Figure 23:
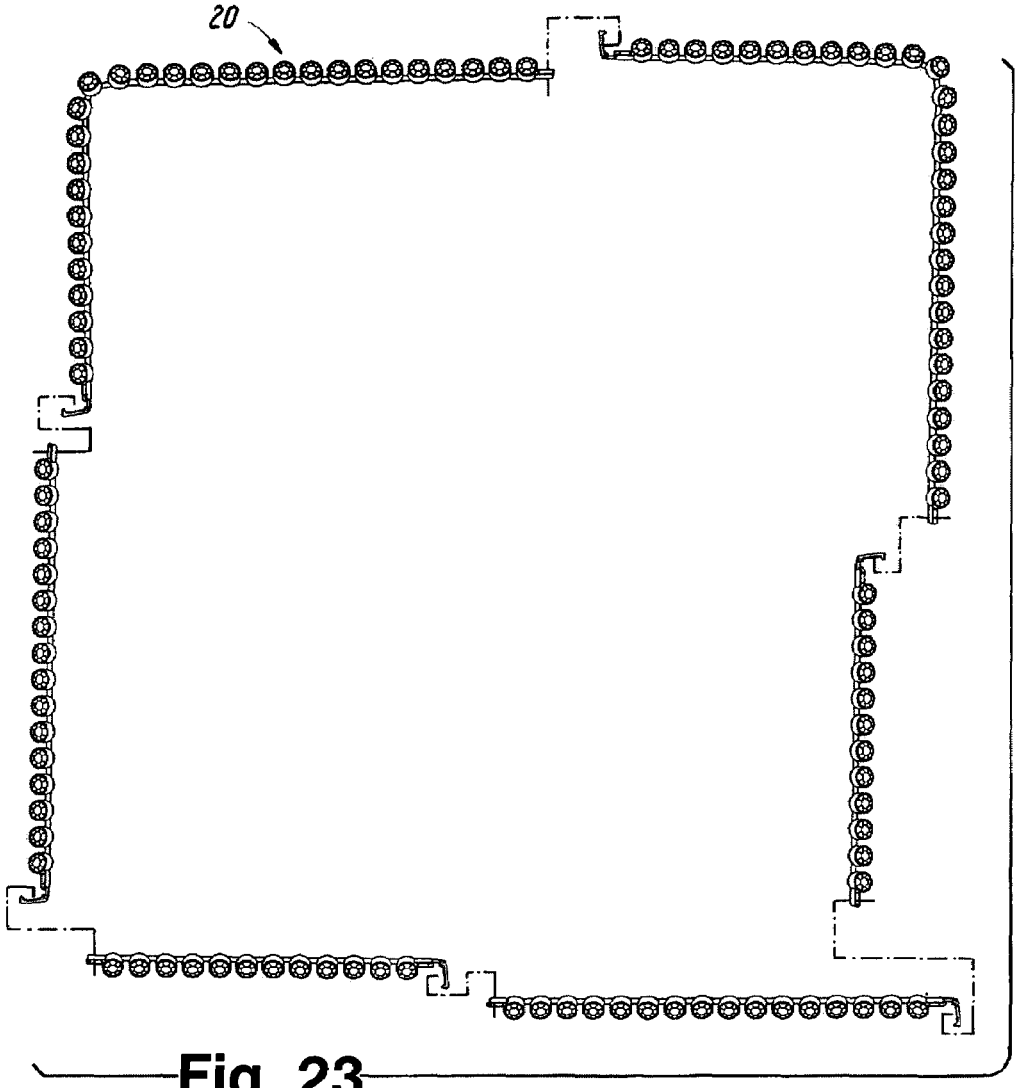
FIG. 23 is a diagrammatic plan view parts separated of the components of a length adjustable, multi-function chain composite functioning as a decorative belly or midriff style strap.
Figure 23A:
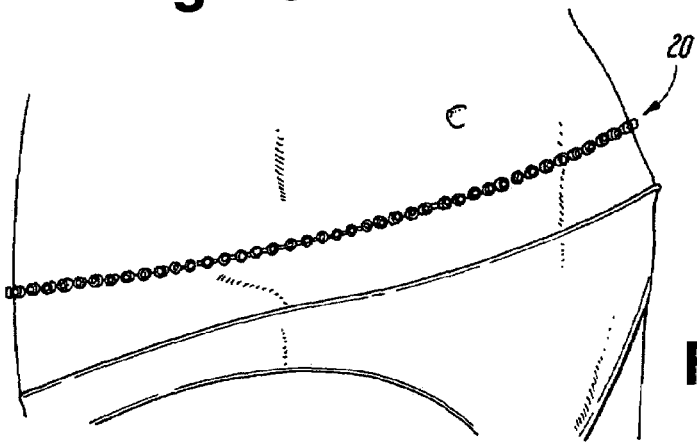
FIG. 23A is a perspective view of the assembled length adjustable, multi-function chain composite of FIG. 23 installed as a decorative belly or midriff style strap on a user.
Figure 24:
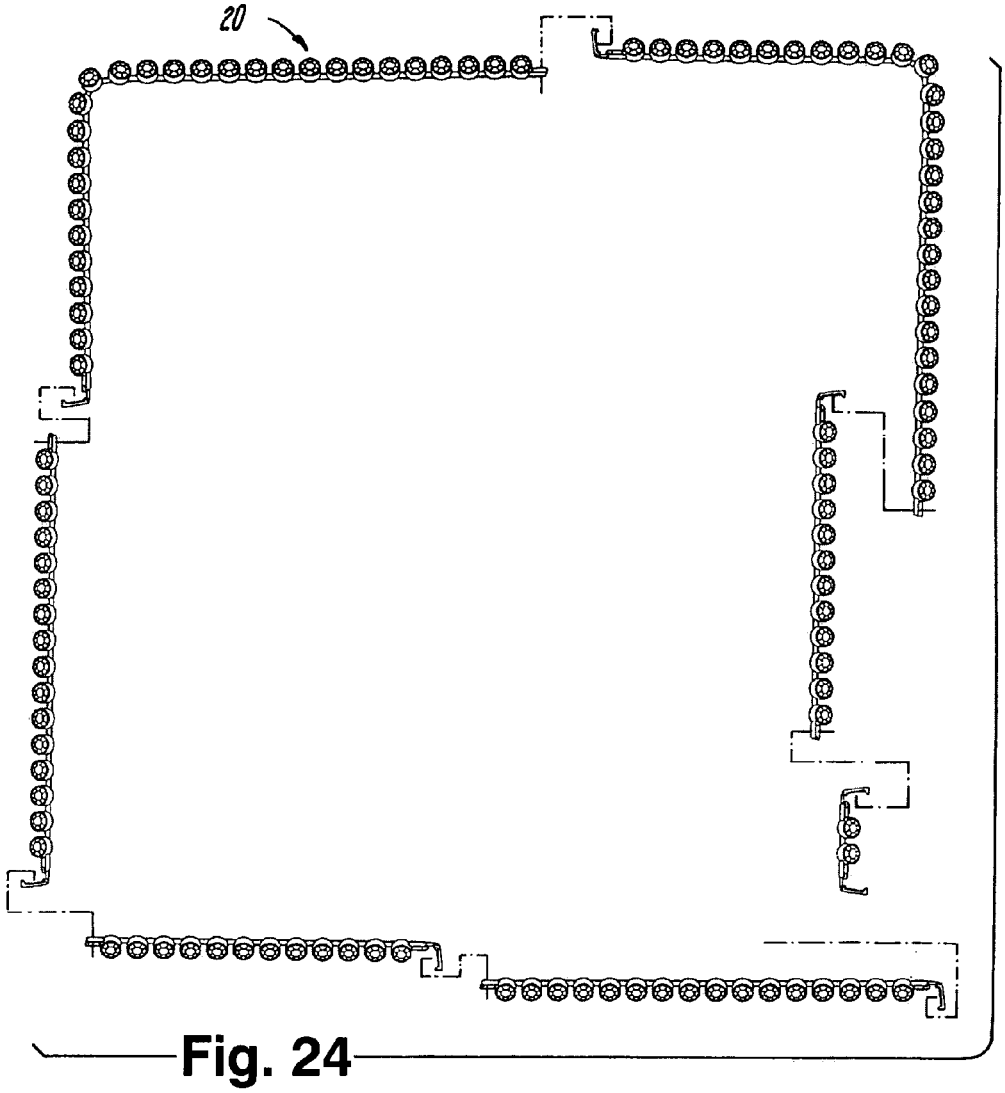
FIG. 24 is a diagrammatic plan view with parts separated of the components of a length adjustable, multi-function chain composite functioning as a decorative belt.
Figure 24A:
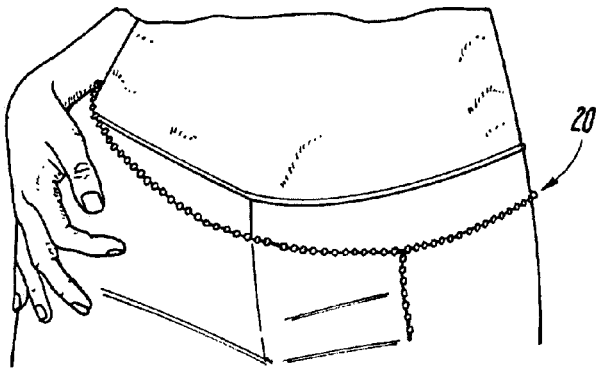
FIG. 24A is a perspective view of the assembled length adjustable, multi-function chain composite of FIG. 24 installed as a decorative belt on a user.
Figure 25:
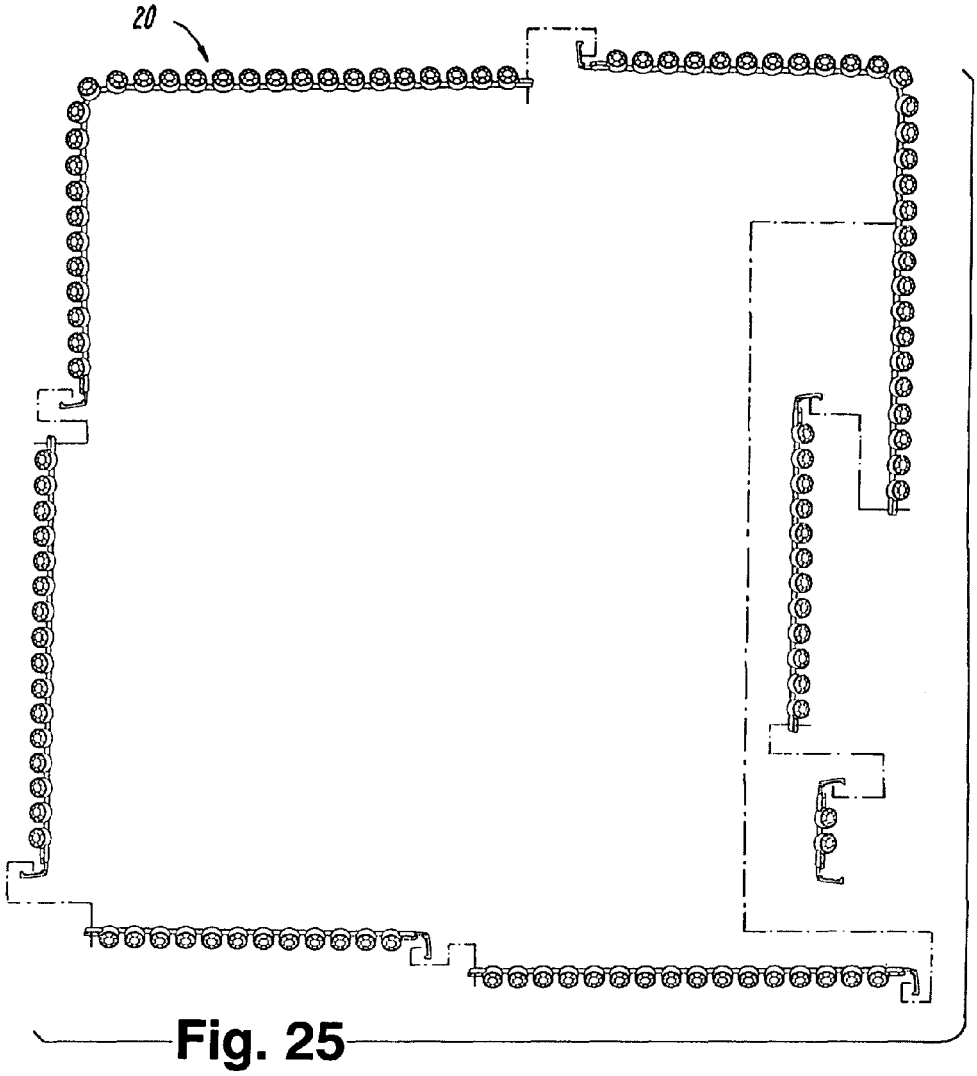
FIG. 25 is a diagrammatic plan view with parts separated of the components of a length adjustable, multi-function chain composite functioning as a decorative lariat.
Figure 25A:
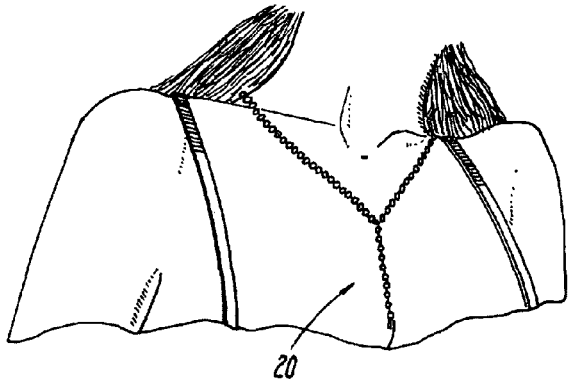
FIG. 25A is a perspective view of the assembled length adjustable, multi-function chain composite of FIG. 25 installed as a decorative lariat on a user.

Thus, a plurality of chain segments 24 can be used. For example:

As shown in FIG. 14, FIG. 24, and FIG. 25, used as a belt or lariat, a plurality of chain segments 24 are attached to each other end-to-end collinearly by primary clasps 28. The terminal end 23 of one terminal chain segment 24 has a primary clasp 28 thereon. The primary clasp 28 on the terminal end 23 of the one terminal chain segment 24 forms a buckle that attaches to an intermediate point along a chain segment 24 so as to form a loop allowing a belt or lariat to be formed with at least a portion of one chain segment 24 dangling free.

As shown in FIGS. 15-23A, a plurality of chain segments 24 are attached to each other end-to-end collinearly by primary clasps 28 to form a closed loop for functioning as a necklace, a bracelet, a belly chain, an ankle bracelet, and the like.

It is clear, therefore, from the descriptions set forth above that the removal and/or addition of chain segments 24 to/from the length adjustable, multi-function chain composite 20 as a result of the structure and configuration of the chain's components, not only provides the user the ability to adjust for the length of the support of the upper torso garment, but also provides the user with a myriad of possibilities limited only by the user's imagination.

It is also clear from the descriptions set forth above that the removal and/or addition of chain segments to/from the length adjustable, multi-function chain composite has unlimited possibilities for functional applications, such as a bracelet, a necklace, an anklet, a belt, a belly chain, a lariat, a handbag strap, etc., and is only limited by the imagination and creativity of the user.

It will be understood that each of the elements described above, or two or more together, may also find a useful application in other types of constructions differing from the types described above.

While the invention has been illustrated and described as embodied in a length adjustable, adaptable and versatile, multi-function chain composite for application and use in the apparel, jewelry, and accessory industries, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A kit comprising a reconfigurable jewelry chain for being multi-functional, comprising:

a) at least two chain segments being separate and independent of each other;

each chain segment having a pair of terminal ends; and b) first means for replaceably attaching said at least two chain segments end-to-end collinearly, said first means includes a connecting mechanism having a male portion and a female portion;

wherein said pair of terminal ends on one of said at least two chain segments has said male portion of said connecting mechanism and said female portion of said connecting mechanism thereon, respectively, and said pair of terminal ends on another one of said at least two chain segments has said male portions of said connecting mechanisms thereon, respectively, so as to allow said jewelry chain to be reconfigurable for being multi-functional; and wherein all said male portions of said connecting mechanisms on said one of said at least two chain segments and on said another one of said at least two chain segments are substantially similar to each other.

2. The kit as defined in claim 1, further comprising second means for replaceably attaching said at least two chain segments to an item.

3. The kit as defined in claim 2, wherein said second means is a closure type mechanism.

4. The kit as defined in claim 2, wherein said closure type mechanism is a secondary clasp.

5. The kit as defined in claim 2, wherein one terminal end of one chain segment is attached to an adjacent terminal end of an adjacent chain segment by said first means so as to form a combined chain segment;

wherein said combined chain segment has terminal ends;

wherein said combined chain segment is for suspending from around the neck of a wearer, over the front of the wearer; and wherein one terminal end of said combined chain segment has said second means thereat for replaceably attaching to the front of an upper torso garment and the other terminal end of said combined chain segment has another said second means thereat for replaceably attaching to the front of the upper torso garment so as to form a halter strap.

6. The kit as defined in claim 2, wherein one terminal end of a first chain segment has said second means thereat for attaching to a front of an upper torso garment and the other terminal end of said first chain segment has another said second means thereat for attaching to a rear of the upper torso garment so as to form a first shoulder strap; and wherein one terminal end of a second chain segment has another said second means thereat for attaching to the front of the upper torso garment and the other terminal end of said second chain segment has another said second means thereat for attaching to the rear of the upper torso garment so as to form a second shoulder strap.

7. The kit as defined in claim 6, wherein one terminal end of a third chain segment has said first means thereat that is attached to said first chain segment, with said third chain segment extending therefrom transversely to said second chain segment where the other terminal end of said third chain segment has another said first means thereat that is attached to said second chain segment, thereby having said third chain segment extend across the back of a wearer.

8. The kit as a defined in claim 7, wherein one terminal end of a fourth chain segment has another said first means thereat that is attached to said first chain segment, with said fourth chain segment extending transversely therefrom, below said third chain segment, to said second chain segment where the other terminal end of said fourth chain segment has another said first means thereat that is attached to said second chain, thereby having said fourth chain segment extend across the back of the wearer.

9. The kit as defined in claim 2, wherein one terminal end of a first chain segment has said second means thereat for attaching to a front of an upper torso garment and the other terminal end of said first chain segment has another said second means thereat for attaching to a rear of the upper torso garment so as to form a first shoulder strap; and wherein one terminal end of a second chain segment has another said second means thereat for attaching to the front of the upper torso garment and the other terminal end of said second chain segment has said first means thereat that is attached to an intermediate point of said first chain segment on the back of a wearer so as to form a second shoulder strap having a Y-configuration along the back of the wearer.

10. The kit as defined in claim 1, wherein each chain segment is comprised of an item selected from the group consisting of a precious metal, a decorative stone, a semi-precious metal, a precious gem, a semi-precious gem, an artificial gem, a pearl, an ornamental clip, a diamond, a bead, a precious stone, a semi-precious stone, a crystal, a stone bead, a glass bead, and combinations thereof.

11. The kit as defined in claim 1, wherein each chain segment is made of a metal.

12. The kit as defined in claim 11, wherein said metal is selected from the group consisting of copper, brass, silver, gold, platinum, titanium, and combinations thereof.

13. The kit as defined in claim 1, wherein said at least two chain segments are one of a same length and different lengths.

14. The kit as defined in claim 1, wherein said connecting mechanism includes adjacent terminal ends of adjacent chain segments.

15. The kit as defined in claim 1, wherein said connecting mechanism includes a pair of loops.

16. The kit as defined in claim 1, wherein said connecting mechanism includes a primary clasp and a pair of loops.

17. The kit as defined in claim 1, wherein a plurality of chain segments are attached to each other end-to-end collinearly by at least one said first means so as to form a combined chain segment having terminal ends; and wherein one terminal end of said combined chain segment has another said first means thereat that forms a buckle that is attached to an intermediate point along a chain segment so as to form a loop allowing one of a belt and a lariat to be formed with a portion of said combined chain segment dangling free.

18. The kit as defined in claim 1, wherein a plurality of chain segments are attached to each other end-to-end collinearly by at least one said first means so as to form a combined chain segment having terminal ends; and wherein one terminal end of said combined chain segment has another said first means thereat that is attached to the other terminal end of said combined chain segment so as to form a closed ring, thereby forming one of a necklace, a bracelet, an ankle bracelet, and a belly chain, depending upon amount of chain segments used.

19. A kit comprising a reconfigurable jewelry chain for being multi-functional comprising:

a) at least two chain segments being separate and independent of each other; each chain segment having a pair of terminal ends;

b) first means for replaceably attaching said at least two chain segments end-to-end collinearly, said first means includes a connecting mechanism having a male portion and a female portion; and c) second means for replaceably attaching said at least two chain segments to an item;

wherein said pair of terminal ends on one of said at least two chain segments has said male portion of said connecting mechanism and said female portion of said connecting mechanism thereon, respectively, and said pair of terminal ends on another one of said at least two chain segments has said male portions of said connecting mechanisms thereon, respectively, so as to allow said jewelry chain to be reconfigurable for being multi-functional;

wherein said second means is a closure type mechanism; and wherein said closure type mechanism is a secondary clasp.

* * * * *